US005991724A

United States Patent [19]

Kojima et al.

[11] Patent Number: 5,991,724

[45] Date of Patent: Nov. 23, 1999

[54] APPARATUS AND METHOD FOR CHANGING REPRODUCTION SPEED OF SPEECH SOUND AND RECORDING MEDIUM

[75] Inventors: Hideki Kojima; Shinta Kimura, both of Kawasaki, Japan

[73] Assignee: Fujitsu Limited, Kawasaki, Japan

[21] Appl. No.: 09/035,106

[22] Filed: Mar. 5, 1998

[30] Foreign Application Priority Data

Mar. 19, 1997 [JP] Japan ..... 9-067007

[51] Int. Cl.[6] ..... G10L 3/02

[52] U.S. Cl. ..... 704/266; 704/278

[58] Field of Search ..... 704/266, 278, 704/270

[56] References Cited

U.S. PATENT DOCUMENTS 5,790,264 8/1998 Sasaki et al. ..... 704/266

FOREIGN PATENT DOCUMENTS 8-292790 11/1996 Japan .
9-7295 1/1997 Japan .
9-63186 3/1997 Japan .

*Primary Examiner*—David R. Hudspeth
*Assistant Examiner*—Daniel Abebe
*Attorney, Agent, or Firm*—Staas & Halsey

[57] ABSTRACT

A reproduction speed of speech sound changing apparatus which reproduces speech data at a speed in which essential part thereof can be caught so that the outline of the speech sound can be grasped even when changing the reproduction speed, besides remarkably reduces the whole reproducing time wherein a reproducing speed in each predetermined period is calculated according to a parameter value in every predetermined period of speech data in accordance with such a manner that a part having a high parameter value such as high power, high pitch or the like of speech data is judged to be the part, where important contents are involved, and such part of important contents is reproduced at such a speed that the contents can be caught, while the parts other than that described above are reproduced either at such a speed that the whole reproduction of speech data can be completed within a required time, or reproduced by skipping over the parts if at thus determined reproduction speed, reproduced speech sound cannot be caught, as a result of paying attention to such fact that voice is louder or pitch of voice becomes higher in the part containing important contents in speech data.

33 Claims, 25 Drawing Sheets

APPARATUS AND METHOD FOR CHANGING REPRODUCTION SPEED OF SPEECH SOUND AND RECORDING MEDIUM

BACKGROUND OF THE INVENTION

The present invention relates to an apparatus for changing reproduction speed of speech sound wherein digital signals of speech sound are reproduced by changing only speed thereof without changing pitch thereof.

In case of reproducing, for example, messages recorded on a magnetic tape in an answer-phone or contents of a lecture or the like recorded by a tape recorder at high speed, the faster tape feed speed results in the higher pitch of the reproduced speech sound. However, when pitch changes from the original speech sound, characteristics (voice quality, male voice, female voice, etc.) belonging to the original speech sound are damaged, and in this respect, a reproduction speed changing apparatus wherein speech sound is reproduced by changing only the reproduction speed at a constant magnification without changing pitch of the original speech sound has been developed.

Meanwhile, in case of hearing a speech, it is difficult to catch the words at both the too fast speed and the too slow speed, so that the contents of the speech cannot be well grasped. In general, it is said that when reproduction speed becomes three times faster, the words cannot be completely caught by even an ordinary person without any handicap. In a conventional reproduction speed changing apparatus, however, since reproduction speed is changed at a constant magnification, there is a limitation for changing magnification in the case when it is intended to increase the reproduction speed within a range in which the contents of speech can be well grasped. Accordingly, a period of time required for reproduction of speech data could have not been remarkably reduced, even if a conventional reproduction speed changing apparatus is employed for the purpose of reproducing speech signals at high speed (quick hearing).

BRIEF SUMMARY OF THE INVENTION

The present invention has been made to solve the problem described above, and an object of the invention is to provide an apparatus for changing a reproduction speed of speech sound wherein a reproducing speed in each predetermined period is calculated according to a parameter value in every predetermined period of speech data in case of reproducing speech data by changing the speed thereof, in such a manner as to judge that a part of speech containing a high parameter value of speech data such as high power, high pitch or the like is the part where important contents are involved, and to reproduce such part of important contents at a speed in which the contents can be caught, but to reproduce the part other than that described above either at a speed in which the whole reproduction of speech data can be completed within a required period of time, or to reproduce the part by skipping over the latter part if the thus determined reproduction speed is the one in which reproduced words cannot be caught, as a result of paying attention to such fact that voice is louder or pitch of voice is higher in an important part containing important contents in speech data.

Thus, according to the apparatus of the present invention, speech data is reproduced at a speed in which essential part thereof can be caught so that the outline of which can be grasped even in case of changing the reproduction speed, besides the whole reproducing time is remarkably reduced.

According to the apparatus of the present invention, a parameter value representing characteristics of speech signals such as loudness and pitch of speech signal is calculated with respect to the speech signal in respective periods sectioned by the uniform time, for example, a reproduction speed in each period is calculated according to the parameter value in such that the reproduction speed in case of reproducing a speech signal of a period where the calculated parameter value is relatively high is relatively slower than the other parts so that the contents of speech data become possible to be caught, and reproduction data in the respective periods are produced according to the calculated reproduction speeds to be joined to each other, whereby speech signals are outputted at a reproduction speed in which important parts can be caught, although the reproduction speed has been changed as a whole.

Thus, according to the apparatus of the present invention, speech data is reproduced at a speed in which essential part thereof can be caught so that the outline of which can be grasped even in case of changing the reproduction speed.

Furthermore, according to the apparatus of the present invention, a reproduction speed in case of reproducing speech signal in each period is calculated by proportioning inversely to a parameter value. Moreover, the reproduction speed is calculated by proportioning inversely to n'th power of the parameter value.

In the case where the reproduction speed is calculated by proportioning inversely to n'th power of the parameter value, a speech signal of an important period is slower than the case where the reproduction speed is simply proportioned inversely to the parameter value, while speech signals of the other periods are reproduced faster than that of the former, whereby the speech sound contained in the important part is emphatically reproduced.

Moreover, according to the apparatus of the present invention, a reproduction speed in case of reproducing a speech signal in each period is proportioned inversely either to a parameter value or to n'th power of the parameter value on the basis of the whole time required for reproducing speech signals, whereby a coefficient of inverse proportion in case of calculation is determined.

Hence, even if the whole reproducing time is remarkably reduced in case of reproduction speed change, essential parts are reproduced at a speed in which the contents thereof can be caught, so that it becomes possible to grasp the outline thereof.

Still further, according to the present invention, speech signals are sectioned by the uniform time, or sectioned with a pause portion in which a predetermined or longer silent time exists, or otherwise sectioned by the like manner, whereby reproduction speed is changed in the respective sections.

Accordingly, for example, even such speech signals in either a case where there are louder speech sounds throughout the first half period, while there are more quiet speech sounds throughout the latter half thereof, or in a case where male voice and female voice exist are subjected to reproduction speed change, there is no fear of skipping over portions of quiet voice throughout, or portions of male voice.

Yet further, according to the apparatus of the present invention, output power in case of reproducing speech signals in each predetermined period is decided according to the parameter value thereof.

Thus, speech signals of the important part are reproduced emphatically in a higher power than the speech signals of the other parts.

Still moreover, according to the apparatus of the present invention, with respect to a speech signal of a period wherein a parameter value is lower than a first predetermined value, the reproduction speed in case of reproduction is set to infinity, and the reproduction speed in case of reproducing such speech signals of a period wherein a parameter value is higher than a second predetermined value is calculated according to the second predetermined value, whereby the upper limit in case of reducing the reproduction speed is defined.

Thus, such a period wherein the reproduction speed in case of reproducing speech signals becomes a speed being as faster as that the speech signals cannot be caught because of too low parameter value is skipped over thereby avoiding waste of reproducing time, while the reproduction speed in case of reproducing speech signals becomes a speed being as slower as that wherein the speech signals cannot be caught because of too high parameter value is avoided.

The above and further objects and features of the invention will more fully be apparent from the following detailed description with accompanying drawings.

DETAILED DESCRIPTION OF THE INVENTION

Figure 1:
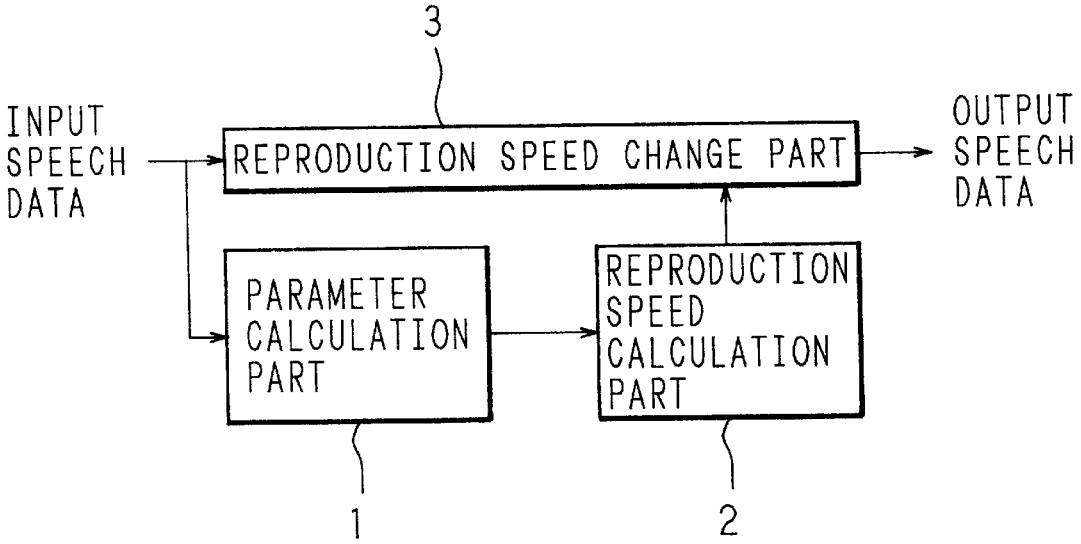
FIG. 1 is a block diagram for explaining the principle of the apparatus for changing reproduction speed of speech sound according to the present invention (hereinafter referred to simply as "the apparatus according to the present invention")

FIG. 1 is a diagram for explaining the principle of the apparatus according to the present invention wherein as a result of paying attention to such fact that an important part of speech data is louder or higher pitch in speaker's voice the apparatus is essentially composed of a parameter calculation part 1 for calculating a parameter value of input speech data indicating characteristics of the speech data such as loudness, and pitch in every predetermined period of the input speech data which is sectioned, for example, by the uniform time; a reproduction speed calculation part 2 for calculating reproducing speed of speech signal of each predetermined period according to the parameter value calculated by the parameter calculation part 1; and a reproduction speed change part 3 for producing reproduced data on the basis of reproducing speed of each predetermined period calculated by the reproduction speed calculation part 2, and joining the resulting reproduced data of respective predetermined periods to each other, thereby outputting speech data that the pitch of which is unchanged, but only the reproduction speed thereof is changed.

Figure 2:
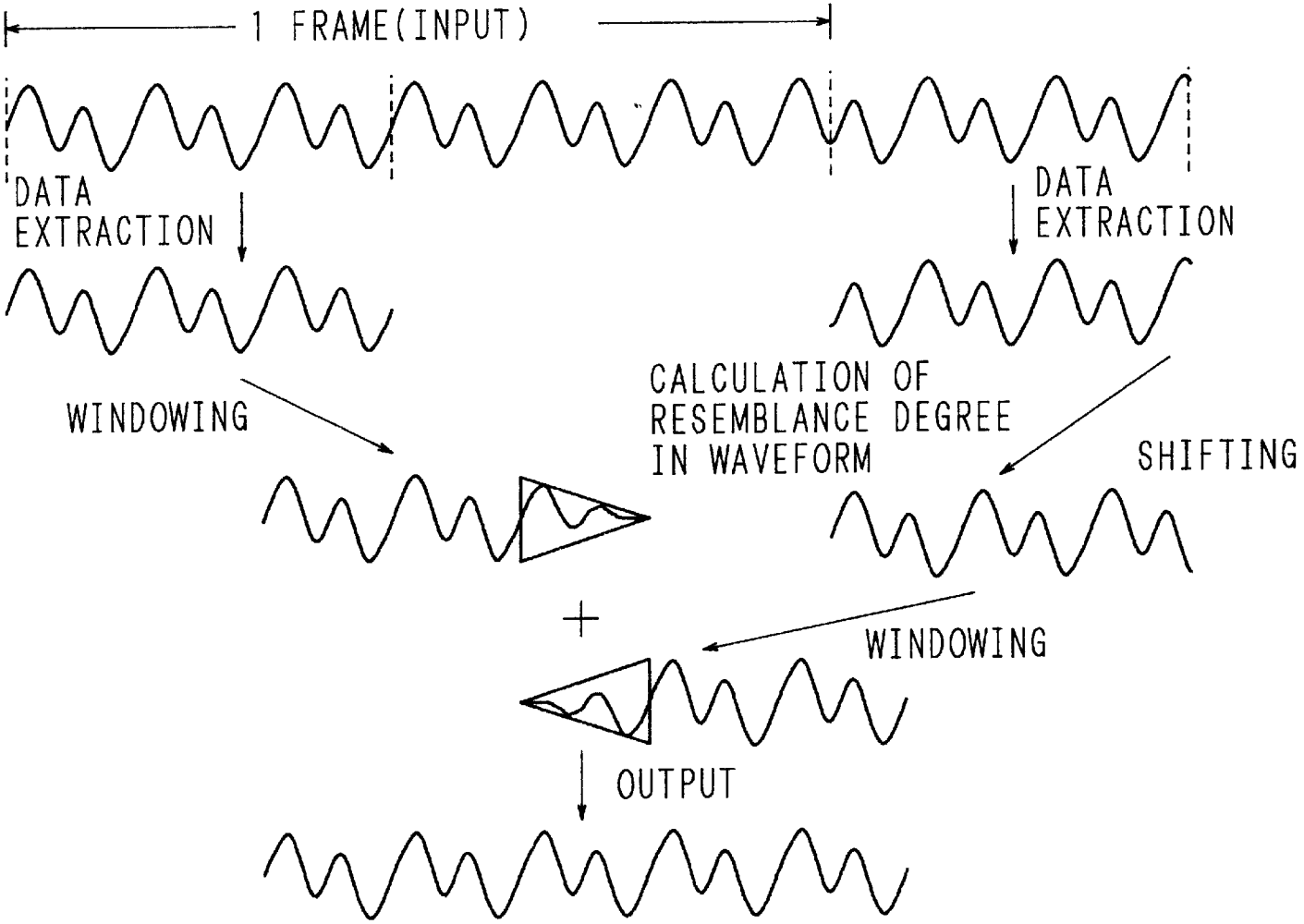
FIG. 2 is a waveform diagram showing an outline of the process of a reproduction speed change part.

FIG. 2 is a waveform diagram showing an outline of processing of the reproduction speed change part 3 wherein ½ of speech data is extracted from speech data in respective frames sectioned by the uniform time in case of halving the reproduction speed, for example. On one hand, such reproduction speed of speech is calculated according to parameter values such as power, and pitch in the respective frames that the reproduction speed of each frame containing speech data which are considered to contain important contents because the parameter values of which are relatively high is reproduced at a relatively slow speed, while the other frames of speech data are reproduced at a relatively fast speed so as not to exceed the whole target reproducing period. Then, a degree of similarity in waveform is calculated from correlation between the head portion of voice waveform in each frame and the tail portion of voice waveform in the previous frame. These frames are shifted in such that the similar portions of waveform are overlapped with each other, and they are windowed to join smoothly the waveforms. Then speech data of each frame is outputted at a reproduction speed which has been previously calculated according to the parameter value of each frame.

Figure 3:
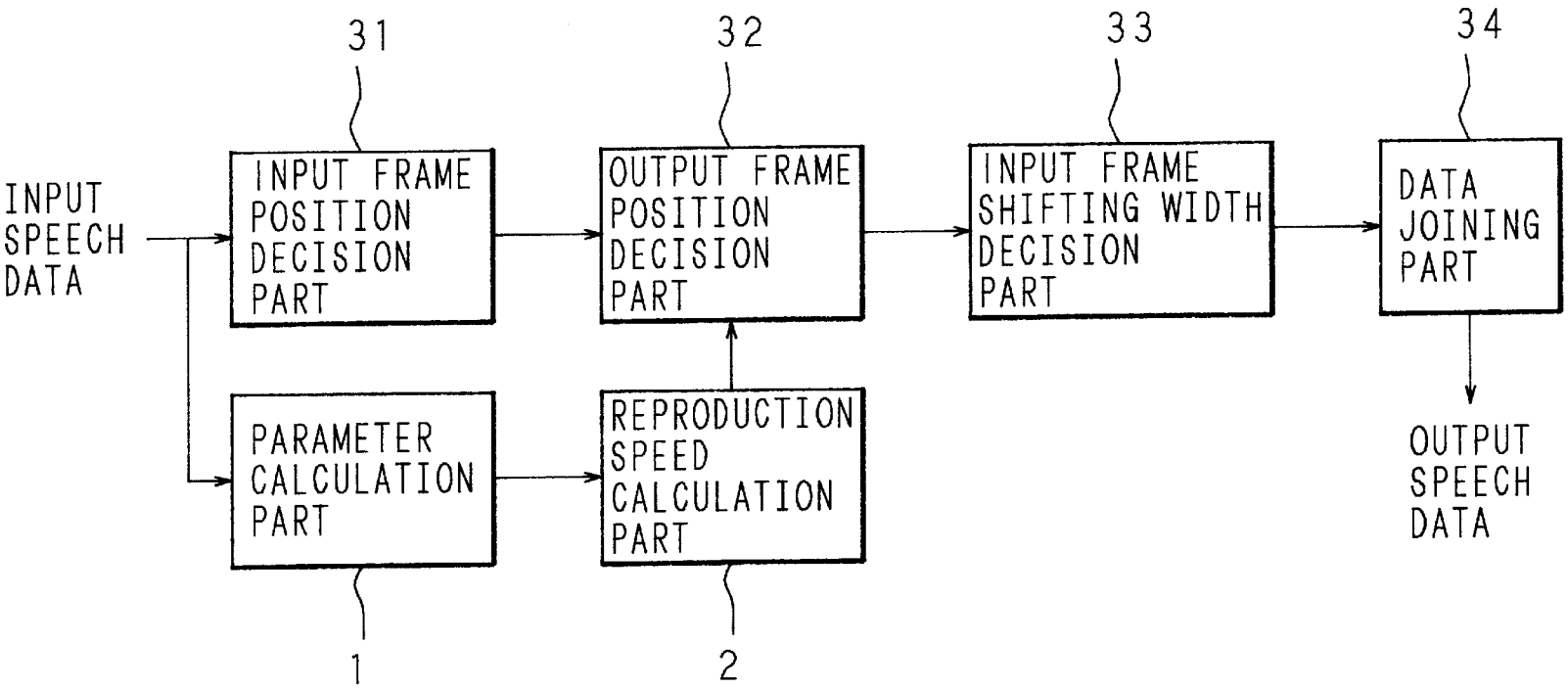
FIG. 3 is a block diagram showing first embodiment of the apparatus according to the present invention.

FIG. 3 is a block diagram showing a first embodiment of the apparatus according to the present invention wherein the parameter calculation part 1 calculates parameter values such as power and pitch in every input frame which is the predetermined period prepared by sectioning input speech data by the uniform time, and passes the results to the reproduction speed calculation part 2.

As a method for calculating speech power, for example, a method for adding absolute values at respective sampling points of digital speech signal, a method for calculating sum-square of signal values at respective sampling points, and the like methods are known.

Furthermore, as a method for calculating speech pitch, auto-correlation method, cepstrum method and the like methods are known.

The reproduction speed calculation part 2 calculates a reproduction speed in each frame according to the parameter values in respective input frames calculated by the parameter calculation part 1 in such a manner that a reproduction speed of the output frame extracted from an input frame having a high parameter value is relatively slow, while it becomes relatively fast in the output frame extracted from an input frame having a low parameter value.

An input frame position decision part 31 divides input speech data by the uniform time. An output frame position decision part 32 sets successively a length of the output frame for producing reproduction data of every frame to a length (input frame length/reproduction speed) according to the reproduction speed in each frame calculated by the reproduction speed calculation part 2.

An input frame shifting width decision part 33 calculates, for example, cross-correlation of each input frame to decide a shifting width of the frame so as to smoothly join the speech signals in adjacent frames to each other.

A data joining part 34, for example, windows the tail portion of the frame previous to a target frame to join thereto in a monotonically decreasing manner, while it windows the head portion of the target frame in a monotonically increasing manner, and the portions to be joined in adjacent frames are added to each other, whereby respective frames are joined smoothly.

In the first embodiment, the above described input frame position decision part 31, the output frame position decision part 32, the input frame shifting width decision part 33, and the data joining part 34 correspond to the reproduction speed change part 3 shown in the principle diagram of FIG. 1.

Figure 4:
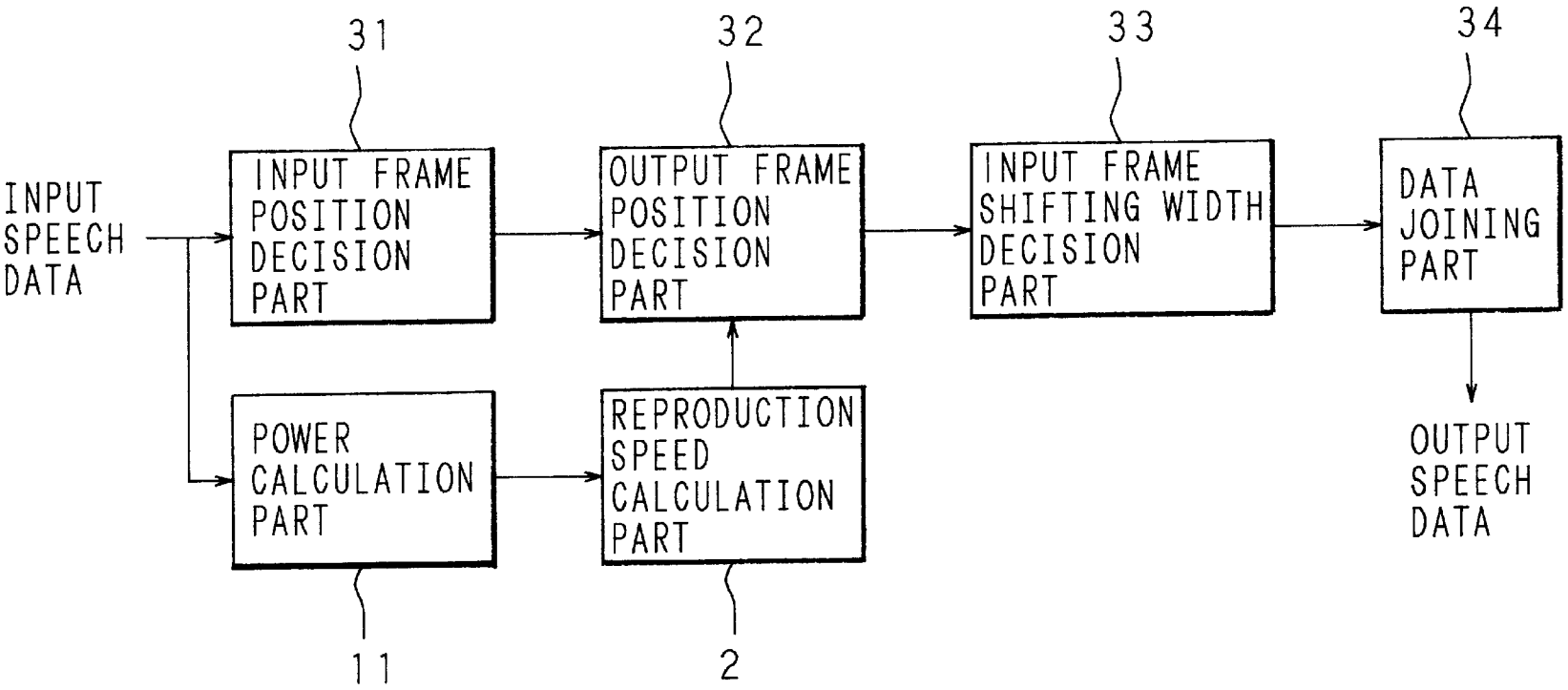
FIG. 4 is a block diagram showing second embodiment of the apparatus according to the present invention.

FIG. 4 is a block diagram showing a second embodiment of the apparatus according to the present invention wherein the same parts as those of FIG. 3 are designated by the same reference numerals, and the explanation therefor will be omitted. In the second manner of practice, as the parameter calculation part 1 of FIG. 2, a power calculation part 11 for calculating a speech loudness, i.e., power in each frame is provided.

As a method for calculating speech power, as mentioned above, for instance, a method for adding absolute values at respective sampling points of digital speech signal, a method for calculating sum-square of signal values at respective sampling points, and the like methods are known.

Figure 5:
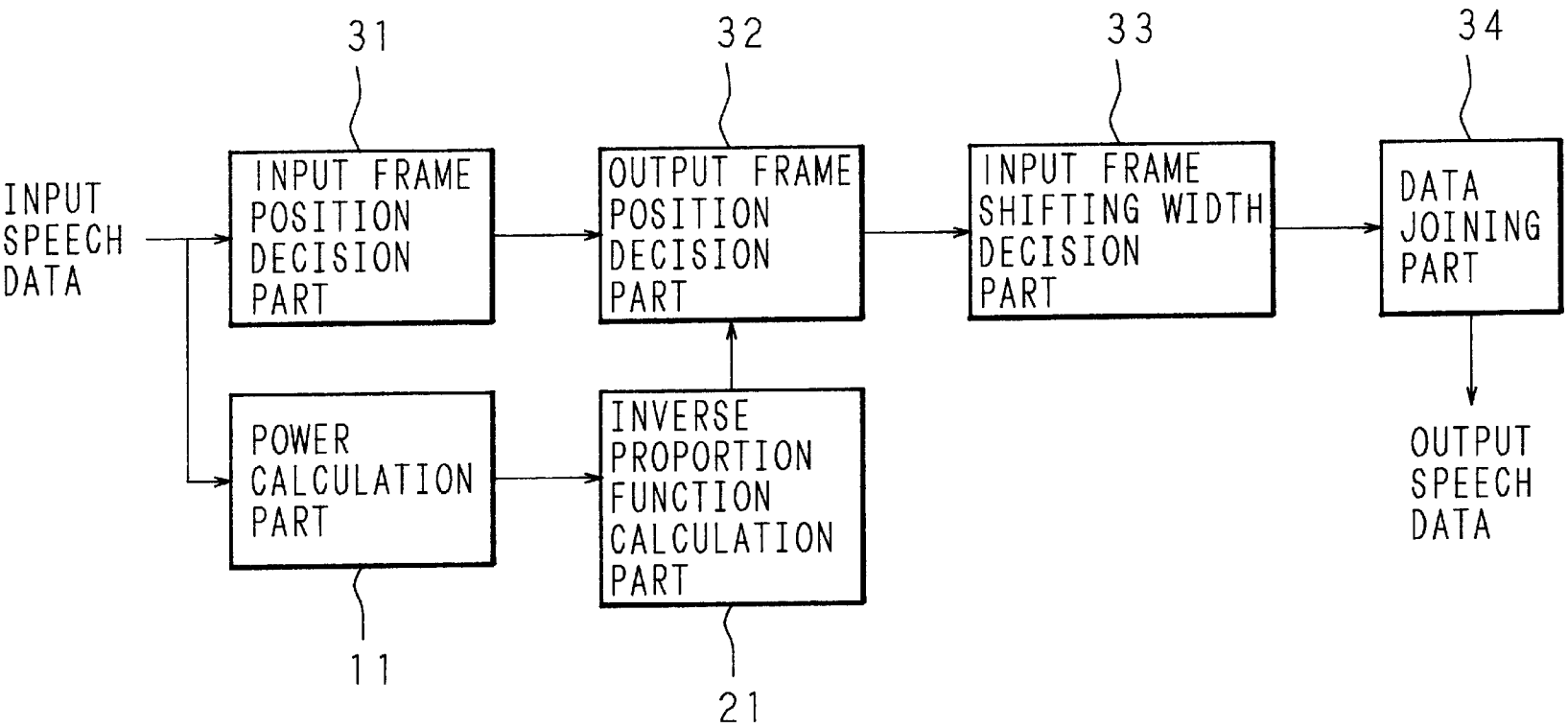
FIG. 5 is a block diagram showing third embodiment of the apparatus according to the present invention.

FIG. 5 is a block diagram showing a third embodiment of the apparatus according to the present invention wherein the same parts as those of FIGS. 3 and 4 are designated by the same reference numerals, and the explanation therefor will be omitted. In the third embodiment, as the reproduction speed calculation part 2 of the first and the second embodiments, an inverse proportion function calculation part 21 for calculating reproduction speed by proportioning inversely the same to a parameter value (power in this example) in each frame is provided.

To calculate the reproduction speed in an input frame having a high parameter value by proportioning inversely the same to the parameter value in such that the reproduction speed becomes slow means that a length of time base of a speech signal extracted from input frame as reproduction data is prolonged proportionately to the parameter value. On the other hand, to calculate the reproduction speed in an input frame having a low parameter value by proportioning inversely the same to the parameter value in such that the reproduction speed becomes fast means that a length of time base of a speech signal extracted from input frame as reproduction data is shortened proportionately to the parameter value.

Figure 6:
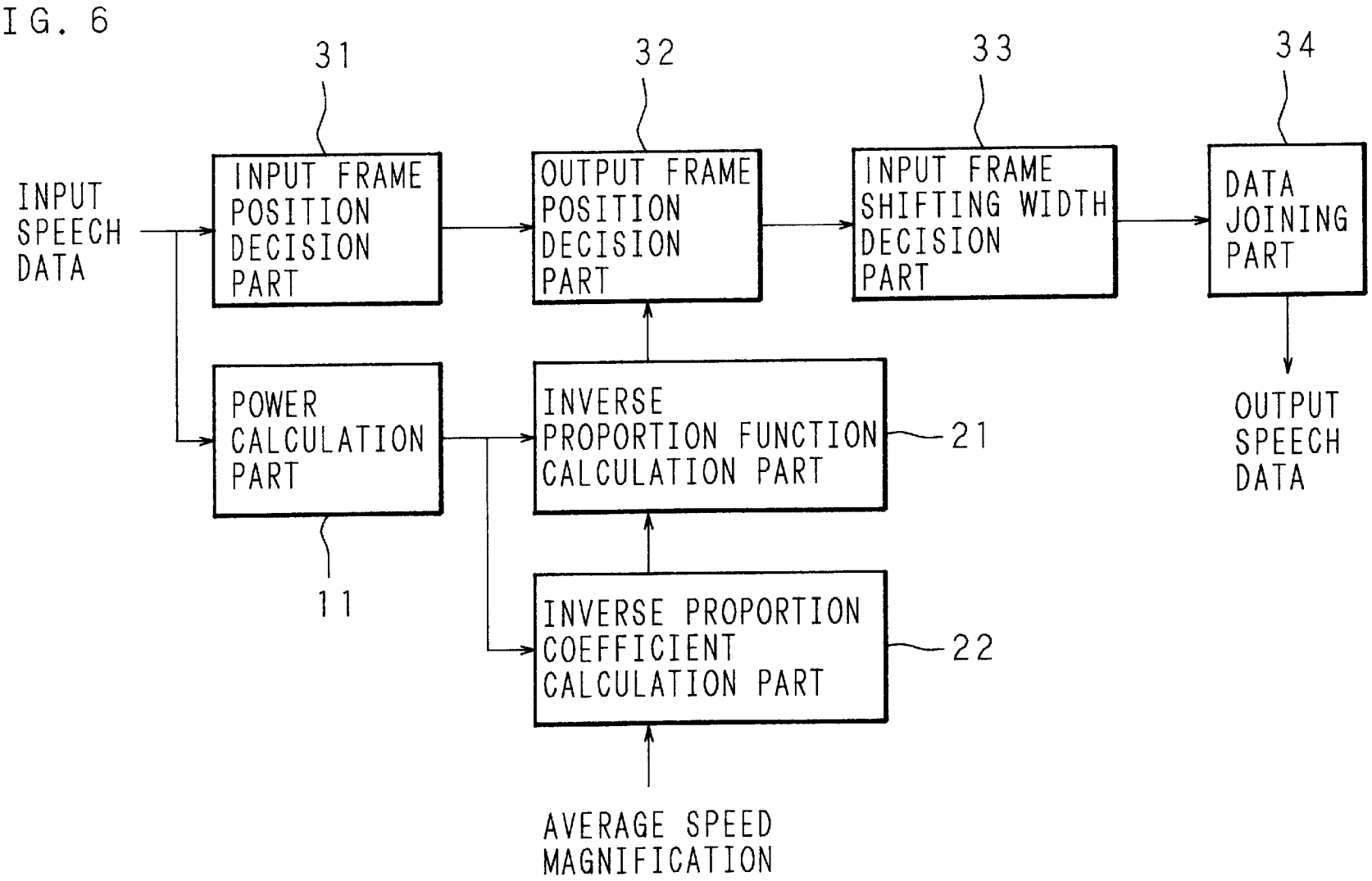
FIG. 6 is a block diagram showing fourth embodiment of the apparatus according to the present invention.

FIG. 6 is a block diagram showing a fourth embodiment of the apparatus according to the present invention wherein the same parts as those of FIGS. 3 and 5 are designated by the same reference numerals, and the explanation therefor will be omitted. In the fourth embodiment, there is provided an inverse proportion coefficient calculation part 22 for calculating a coefficient of inverse proportion for changing speed magnification of the speech signal as a whole (called as average speed magnification) which is determined by a ratio of the whole time for reproduction to the whole time of the original speech signal into a reproduction speed according to parameter values in respective frames in addition to the third embodiment. Thus, when an inverse coefficient of reproduction speed of each frame is calculated on the basis of the average speed magnification relating to the whole time of reproduction, such reproduction speed is calculated according to a parameter value of each frame in a certain reproducing time.

Accordingly, in even a case of reproduction at a triple-or faster speed wherein catching of words is impossible when reproduction speed is evenly sped up in each frame, the words in important portions can be caught.

One example of the calculation formula of an inverse proportion coefficient in the case where the speech signal is reproduced at $\alpha$-times faster speed with respect to the original length thereof where P(i) is a power in each frame, L is a length of the original speech signal, and K is the inverse proportion coefficient will be described hereinafter.

$$\sum_{i=1}^{L} K \cdot P(i) = \alpha \cdot L$$

$$K \cdot \sum_{i=1}^{L} P(i) = \alpha \cdot L$$

$$K = \frac{\alpha \cdot L}{\sum_{i=1}^{L} P(i)}$$

Figure 7:
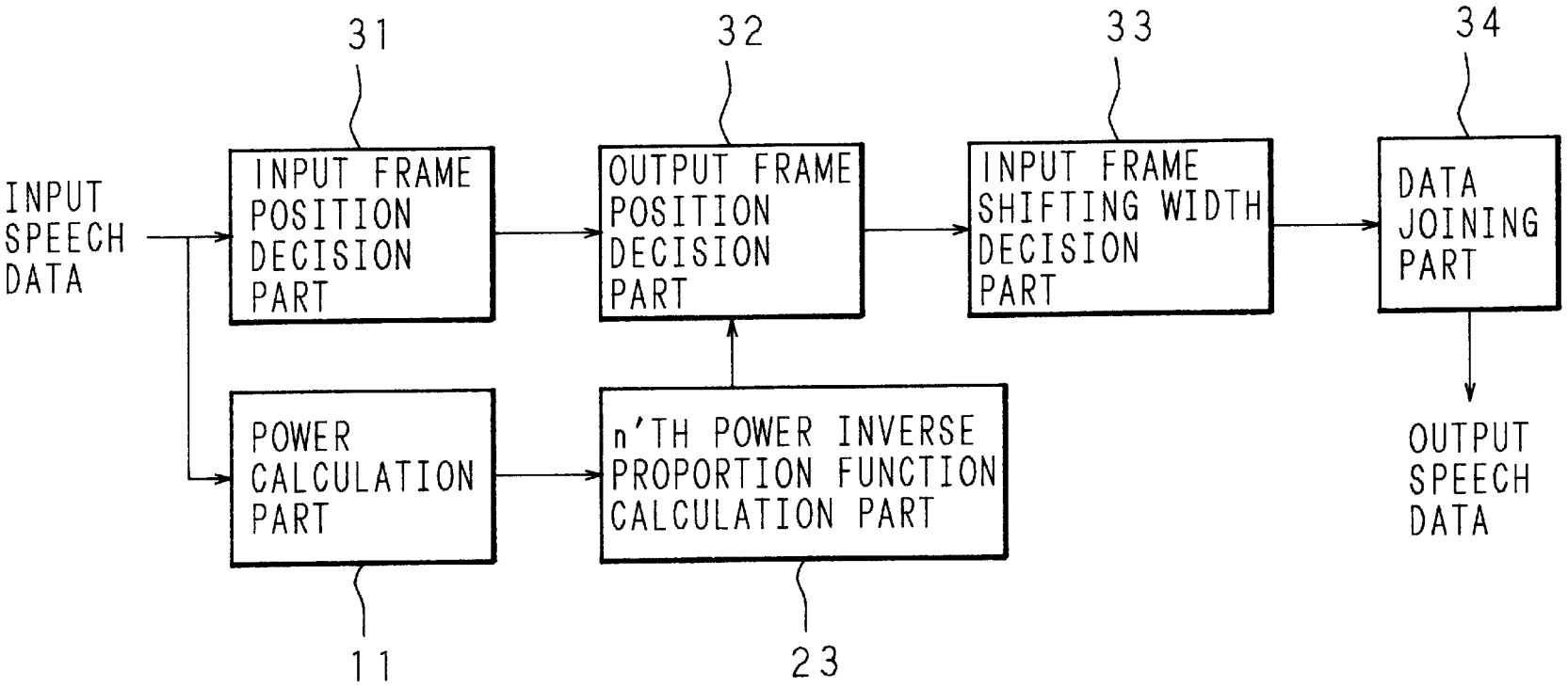
FIG. 7 is a block diagram showing fifth embodiment of the apparatus according to the present invention.

FIG. 7 is a block diagram showing a fifth embodiment of the apparatus according to the present invention. The same parts as those of FIGS. 3 through 5 are designated by the same reference numerals, and the explanation therefor will be omitted. In the fifth embodiment, as the reproduction speed calculation part 2 of the first and the second embodiments, there is provided an n'th power inverse proportion function calculation part 23 for calculating reproduction speed of speech sound by proportioning inversely the reproduction speed to the n'th power of a parameter value (power in the present example) in each frame.

In the fifth embodiment, a portion having a higher parameter value is emphatically reproduced at a slower speed than that in the third embodiment.

Figure 8:
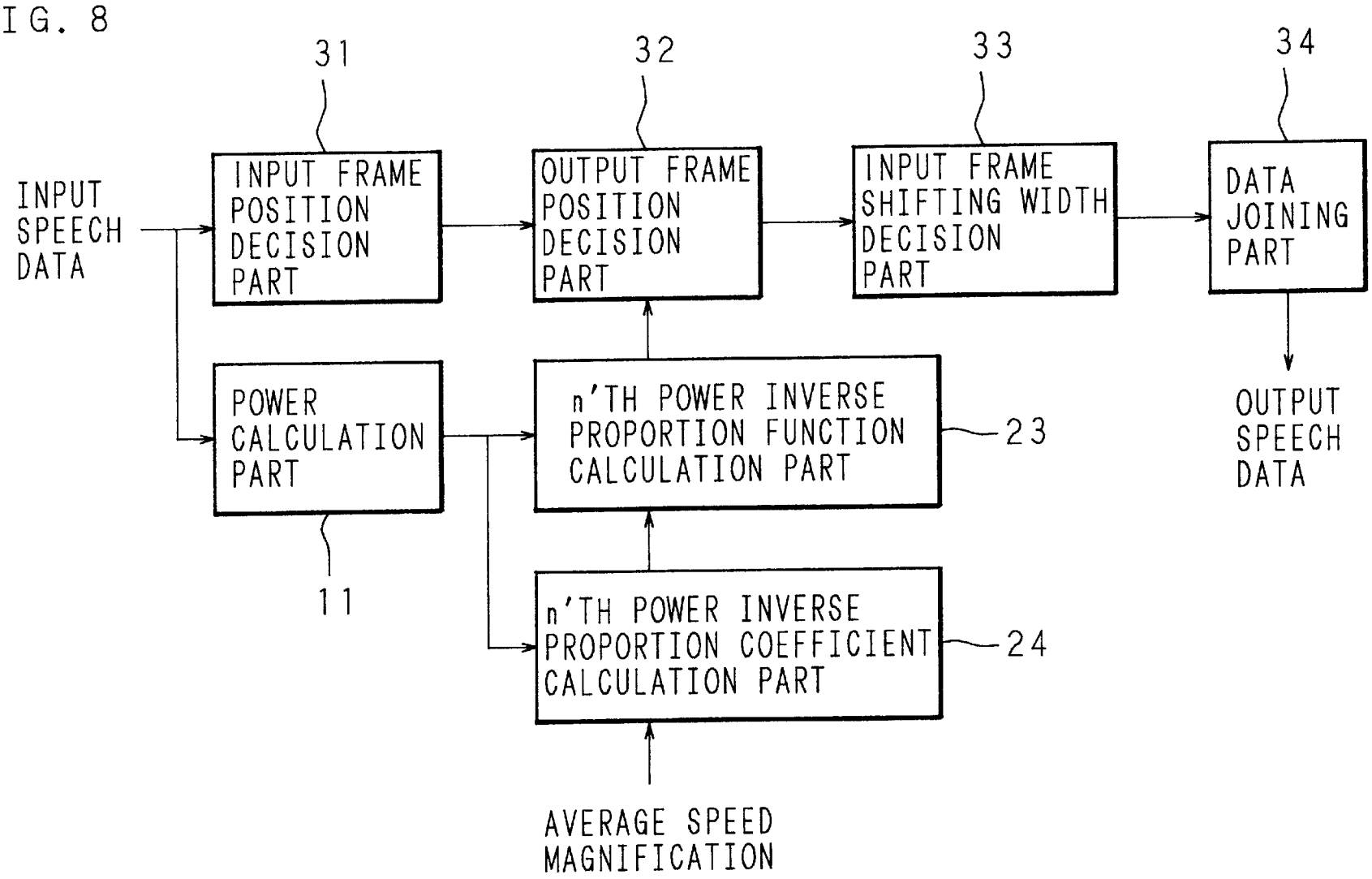
FIG. 8 is a block diagram showing sixth embodiment of the apparatus according to the present invention.

FIG. 8 is a block diagram showing a sixth embodiment of the apparatus according to the present invention. The same parts as those of FIGS. 3 and 7 are designated by the same reference numerals, and the explanation therefor will be omitted. In the sixth embodiment, there is provided an n'th power inverse proportion coefficient calculation part 24 for calculating a coefficient of inverse proportion for changing speed magnification of speech sound as a whole so-called average speed magnification which is determined by a ratio of the whole time for reproduction to the whole time of the original speech signal into a reproduction speed according to n'th power of parameter values in respective frames in addition to the fifth embodiment. Thus, when an inverse coefficient of reproduction speed in each frame is calculated on the basis of the average speed magnification relating to the whole time in reproduction, such reproduction speed is calculated according to a parameter value in each frame in a certain reproducing time.

Accordingly, in even a case of reproduction at a triple-or faster speed wherein catching of words is impossible when reproduction speed is evenly sped up in each frame, the words in important portions can be caught.

One example of calculation formula of an inverse proportion coefficient in the case where the speech signal is reproduced at α-times faster speed with respect to the original length thereof where P(i) is a power in each frame, L is a length of the original speech signal, and K is the inverse proportion coefficient will be described hereinafter.

$$\sum_{i=1}^{L} K \cdot P(i)^n = \alpha \cdot L$$

$$K \cdot \sum_{i=1}^{L} P(i)^n = \alpha \cdot L$$

$$K = \frac{\alpha \cdot L}{\sum_{i=1}^{L} P(i)^n}$$

Figure 9:
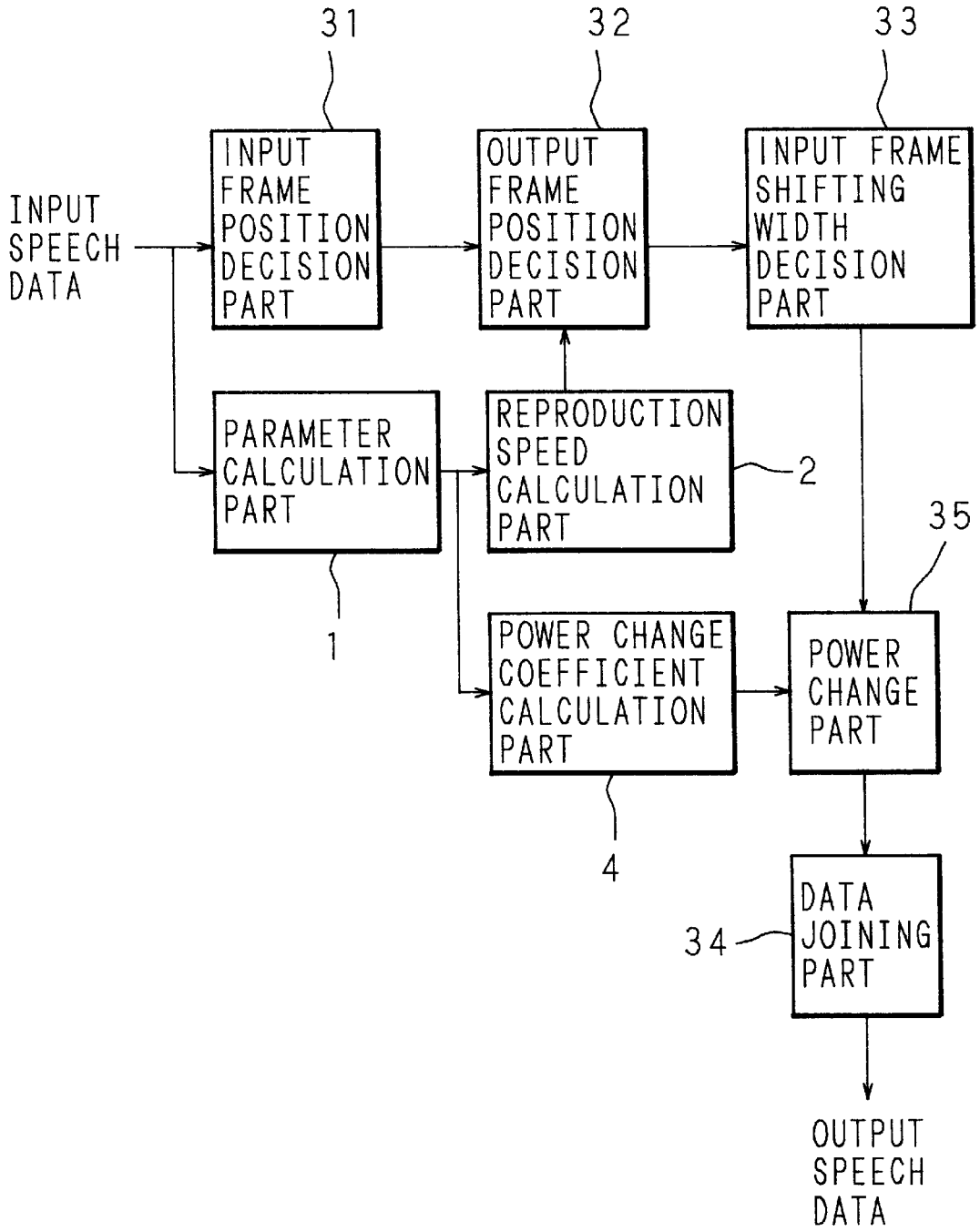
FIG. 9 is a block diagram showing seventh embodiment of the apparatus according to the present invention.

FIG. 9 is a block diagram showing a seventh embodiment of the apparatus according to the present invention. The same parts as those of FIG. 3 are designated by the same reference numerals, and the explanation therefor will be omitted. The seventh embodiment differs from the first embodiment in that there are provided a power change coefficient calculation part 4 for calculating a change coefficient of deciding an output power of speech signal in each frame on the basis of a parameter value such as power, pitch or the like in each frame to supply the resulting change coefficient to a power change part 35, and the power change part 35 for changing output power with the change coefficient calculated by the power change coefficient calculation part 4 to supply the resulting output power to the data joining part 34.

Thus, an important frame is emphatically reproduced by a larger power.

In the seventh embodiment, the above described input frame portion decision part 31, output frame position decision part 32, input frame shifting width decision part 33, power change part 35, and data joining part 34 correspond to the reproduction speed change part 3 in the principle diagram shown in FIG. 1.

Figure 10:
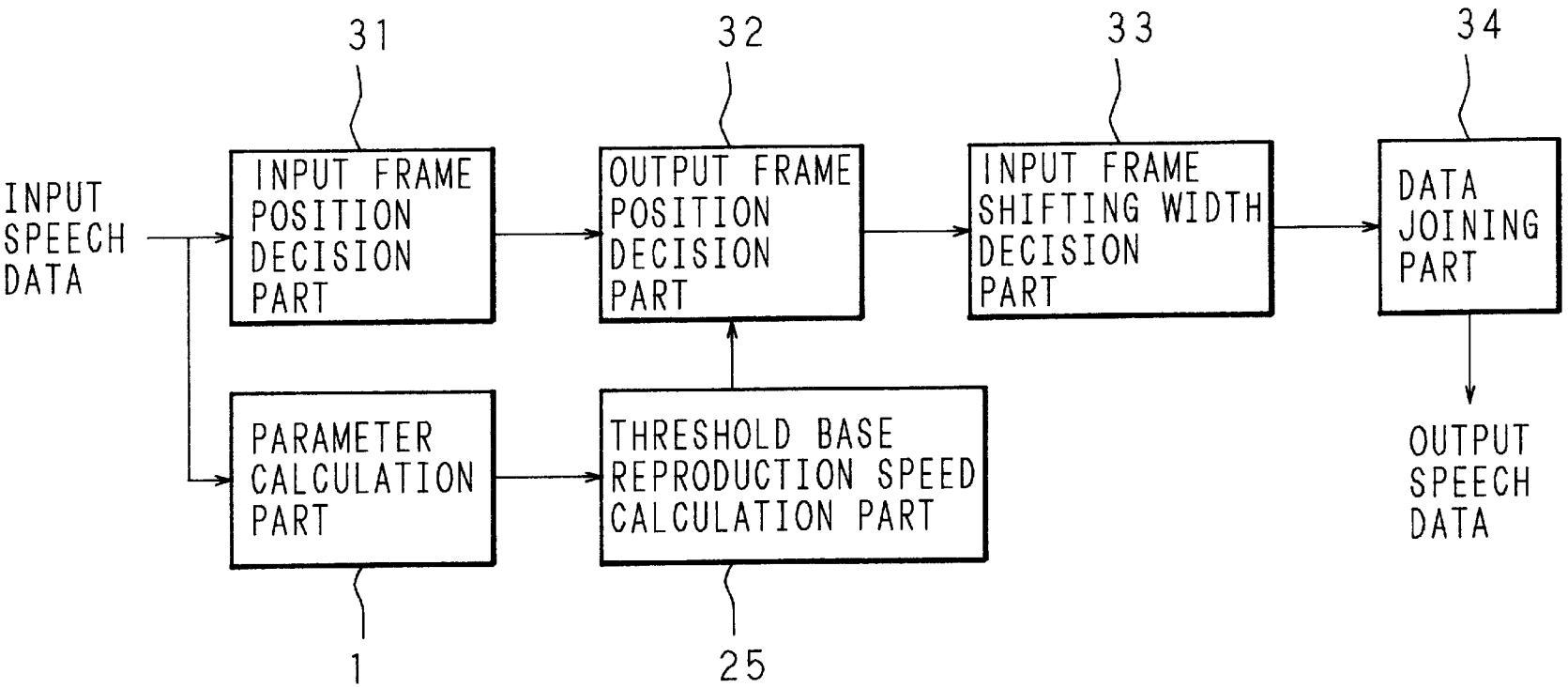
FIG. 10 is a block diagram showing eighth embodiment of the apparatus according to the present invention.

FIG. 10 is a block diagram showing an eighth embodiment of the apparatus according to the present invention. The same parts as those of FIG. 3 are designated by the same reference numerals, and the explanation therefor will be omitted. In the eighth embodiment, as the reproduction speed calculation part 2 of the first embodiment, there is provided a threshold base reproduction speed calculation part 25. The part 25 sets reproduction speed of the speech signal to infinity when a parameter value in a frame is less than a first threshold value. The threshold base reproduction speed calculation part 25 calculates reproduction speed of the speech signal in a frame according to a second threshold value, when the parameter value in the frame is higher than the second threshold value, whereby the upper limit in case of reducing reproduction speed is set.

In other words, speech sound in such a frame of too low parameter value where the reproduction speed becomes so fast as to catch the words is impossible is skipped over, and no speech sound in the frame is reproduced, whereby reproducing time is saved.

On the other hand, speech sound in such a frame of too high parameter value where the reproduction speed becomes so slow as to impossible to catch the words is changed into the speech sound with reproduction speed at which words can be caught.

FIGS. 11 through 23 are flowcharts each illustrating an example of operation in the apparatus according to the present invention.

Figure 11:
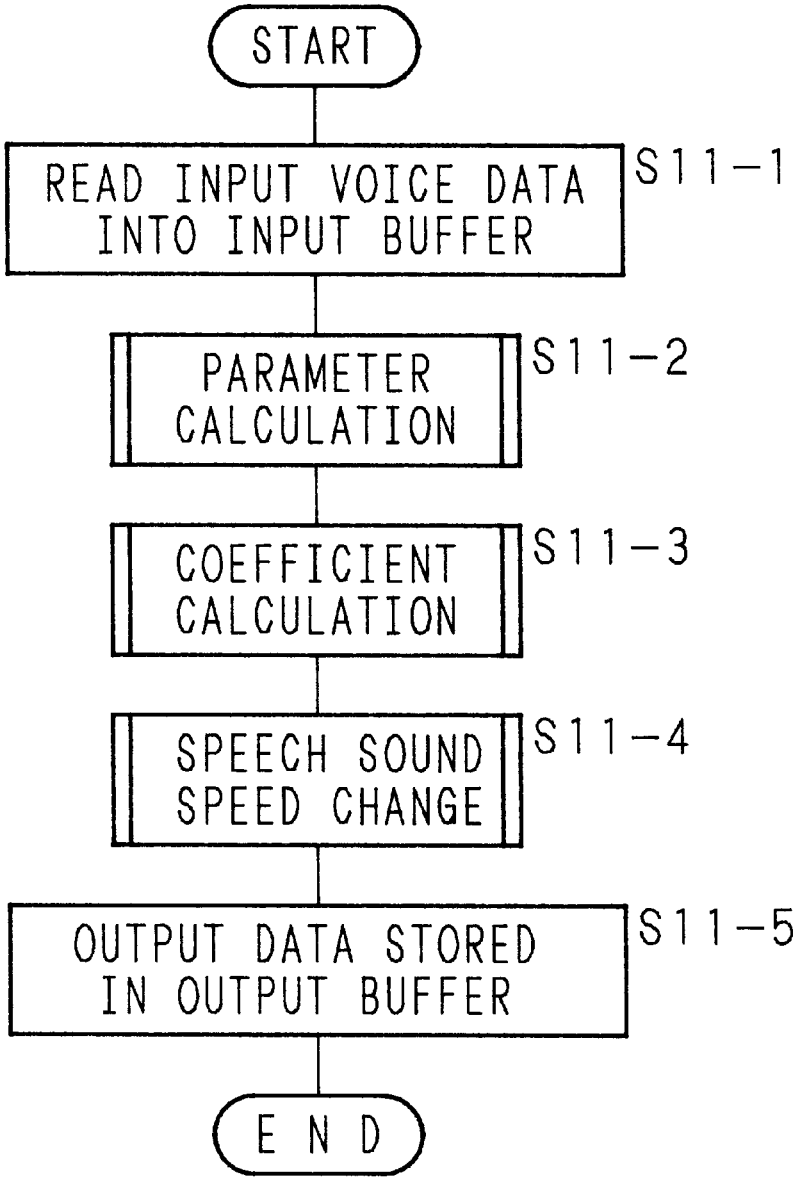
FIG. 11 is a flowchart of an outline of the operation in the apparatus according to the present invention.

FIG. 11 is a flowchart illustrating an outline of the operation wherein input speech sound is sectioned by the uniform time, and they are inputted to an input buffer (not shown) wherein one section is treated as one frame (S11-1). Parameters such as power, pitch and the like in respective frames are calculated (S11-2). A coefficient for determining a reproduction speed of speech data extracted from each frame is calculated on the basis of the resulting parameters in such that such speech data with the relatively high parameter value among voiced sounds, in other words, a frame which is considered to contain important contents is reproduced at a relatively slow speed, while either the other frames are reproduced at a relatively fast speed so as not to exceed a target reproducing time, or they are skipped over in reproduction (S11-3). The resulting coefficient is multiplied with a length of time base of each frame to change reproduction speed of the speech data in each frame into the speech data with reproduction speed according to the parameter thereby the speech data thus changed is stored in an output buffer (not shown) (S11-4), and the contents of the output buffer are outputted (S11-5).

Figure 12:
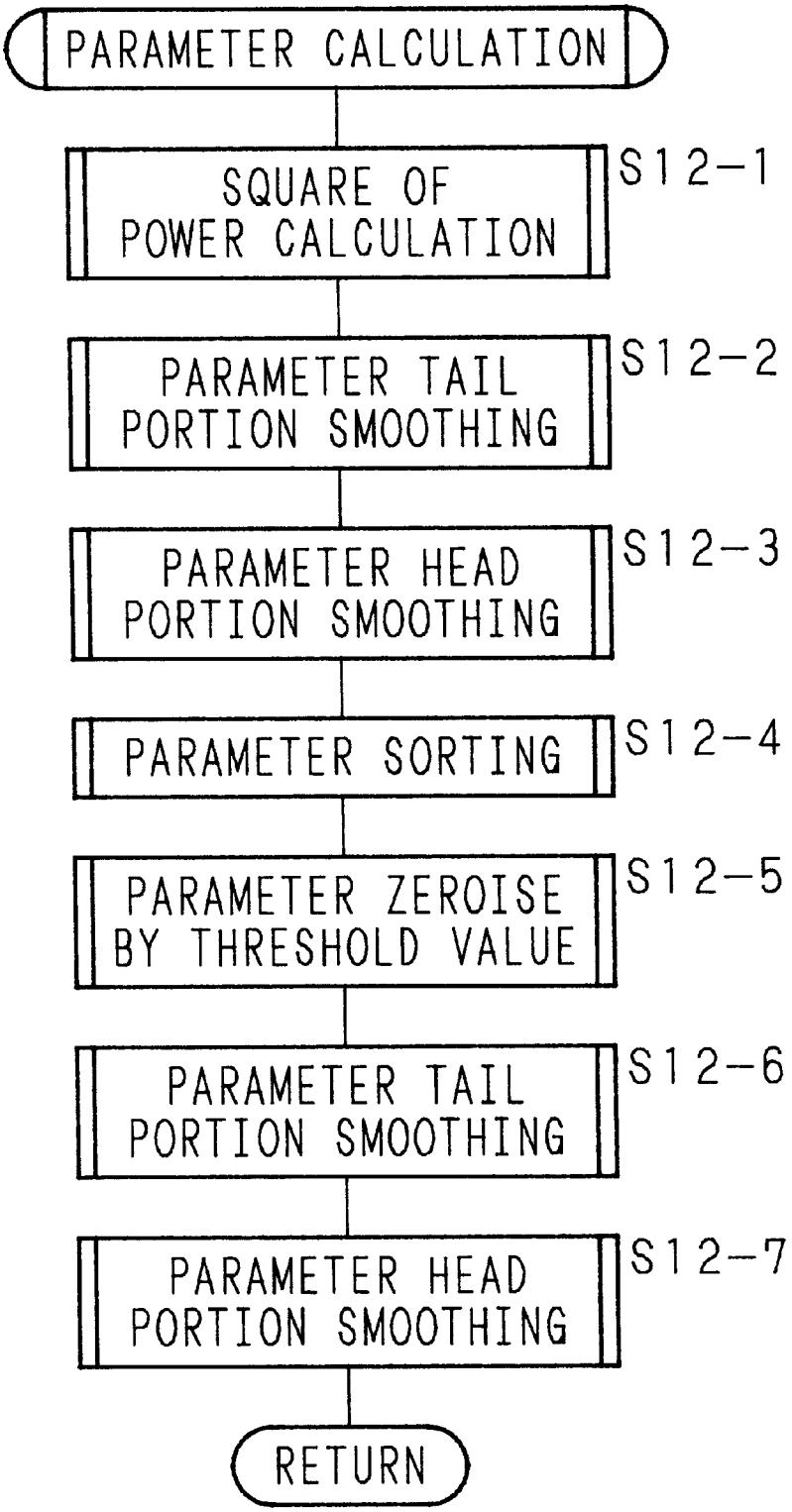
FIG. 12 is a flowchart of a process for parameter calculation in the apparatus according to the present invention.

FIG. 12 is a flowchart illustrating parameter calculating process (S11-2 in FIG. 11). A power square calculation in each frame is conducted (S12-1), and parameter tail portion smoothing (S12-2) and parameter head portion smoothing processes (S12-3) are carried out in such a manner that, for example, only the sound "bun" which is accented in "bungalow" and has high power is not to be extracted as reproduced speech data. The parameters are sorted in the order of loudness (S12-4), and parameters less than a threshold value are zeroised with the predetermined threshold value (S12-5). The parameters which remain as a result of such zeroising are subjected to tail portion smoothing (S12-6) and head portion smoothing processes (S12-7), respectively.

Figure 13:
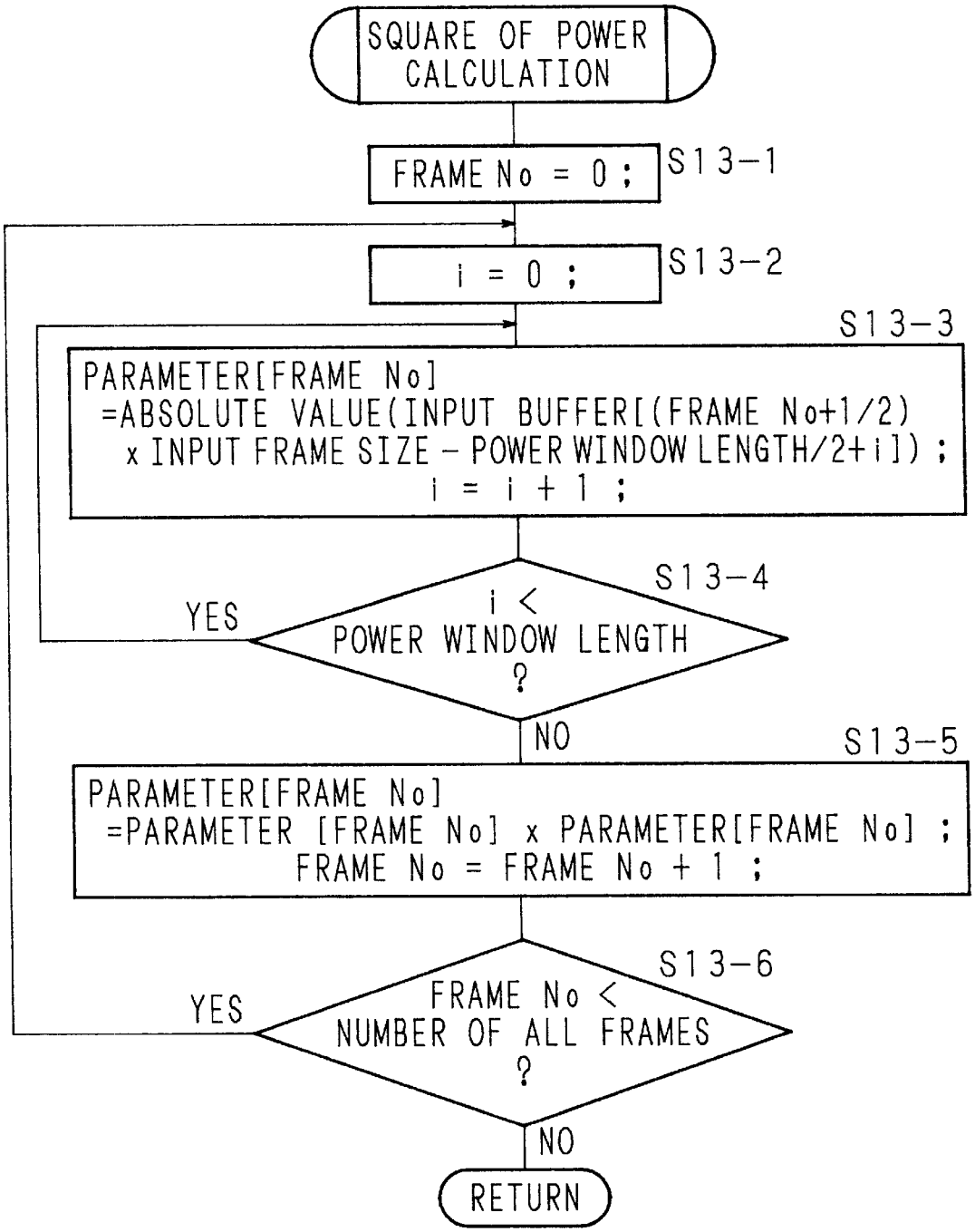
FIG. 13 is a flowchart of a process for power square calculation in the apparatus according to the present invention.

FIG. 13 is a flowchart illustrating a power square calculation process (Step S12-1 in FIG. 12) wherein it is to be noted that in case of reading data into an input buffer in the following execution of algorithm, it starts from the input buffer [0]. In this case, it is supposed to be that there are sufficient number of "0s" before and after the data, and further that all the initial values in output buffer are "0".

Frame number and variable "i" of sampling point are initialized to "0" (S13-1, S13-2). A parameter in frame is determined by "absolute value (input buffer [(frame number+½)×input frame size -power window length/2+i])" to increment "i" by 1 (S13-3). Until the variable "i" reaches the power window length (S13-4), the step S13-3 is repeated.

When "i" reaches the power window length, the parameter of the frame is squared, then the frame number is incremented by 1 (S13-5). Until the frame number reaches a total frame number (S13-6), the above described steps S13-2 to S13-5 are repeated.

Figure 14:
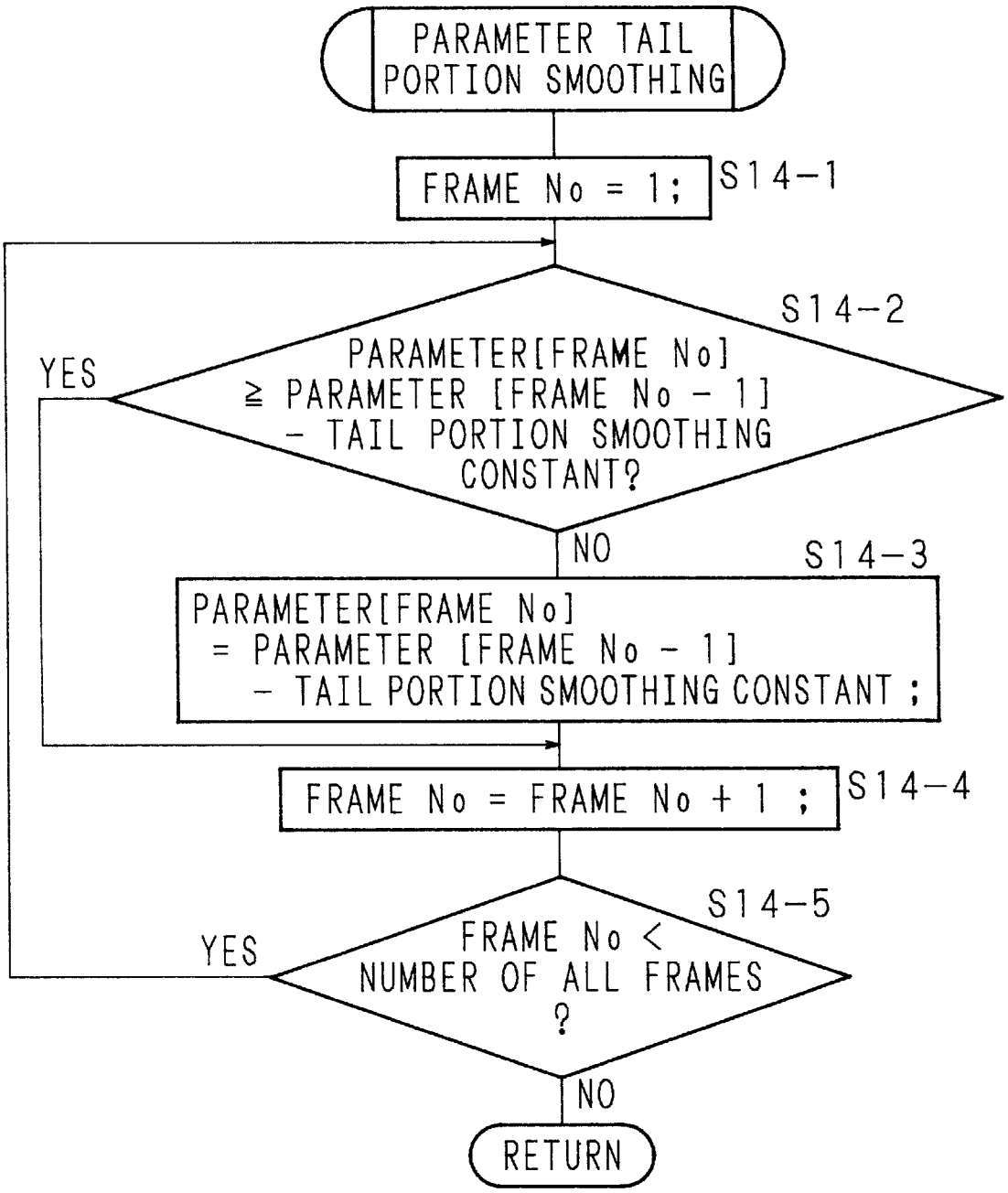
FIG. 14 is a flowchart of a process for parameter tail portion smoothing in the apparatus according to the present invention.

FIG. 14 is a flowchart illustrating a process for parameter tail portion smoothing (S12-2 and S12-6 in FIG. 12). Frame number is initialized to "1" (S14-1), and it is judged whether or not a parameter of the frame is equal to or more than a value obtained by subtracting a prescribed tail portion smoothing constant from a parameter of the previous frame (S14-2). Since the parameter of the frame with the frame number 1 is equal to or more than the questioned value, the frame number is incremented by "1" (S14-4), and it is judged whether or not the frame number exceeds the total frame number (S14-5). If it does not exceed the frame number, the procedure returns to the step S14-2 so that it is judged whether or not a parameter in the frame is equal to or more than a value obtained by subtracting the prescribed tail portion smoothing constant from a parameter in the previous frame (S14-2). If the parameter in the frame is less than the questioned value ("No" in S14-2), the parameter of that frame number is made to be a value obtained by subtracting the tail portion smoothing constant from the parameter of the frame with the previous frame number (S14-3). Until the frame number reaches the total frame number (S14-5), the above described steps S14-2 to S14-4 are repeated.

Figure 15:
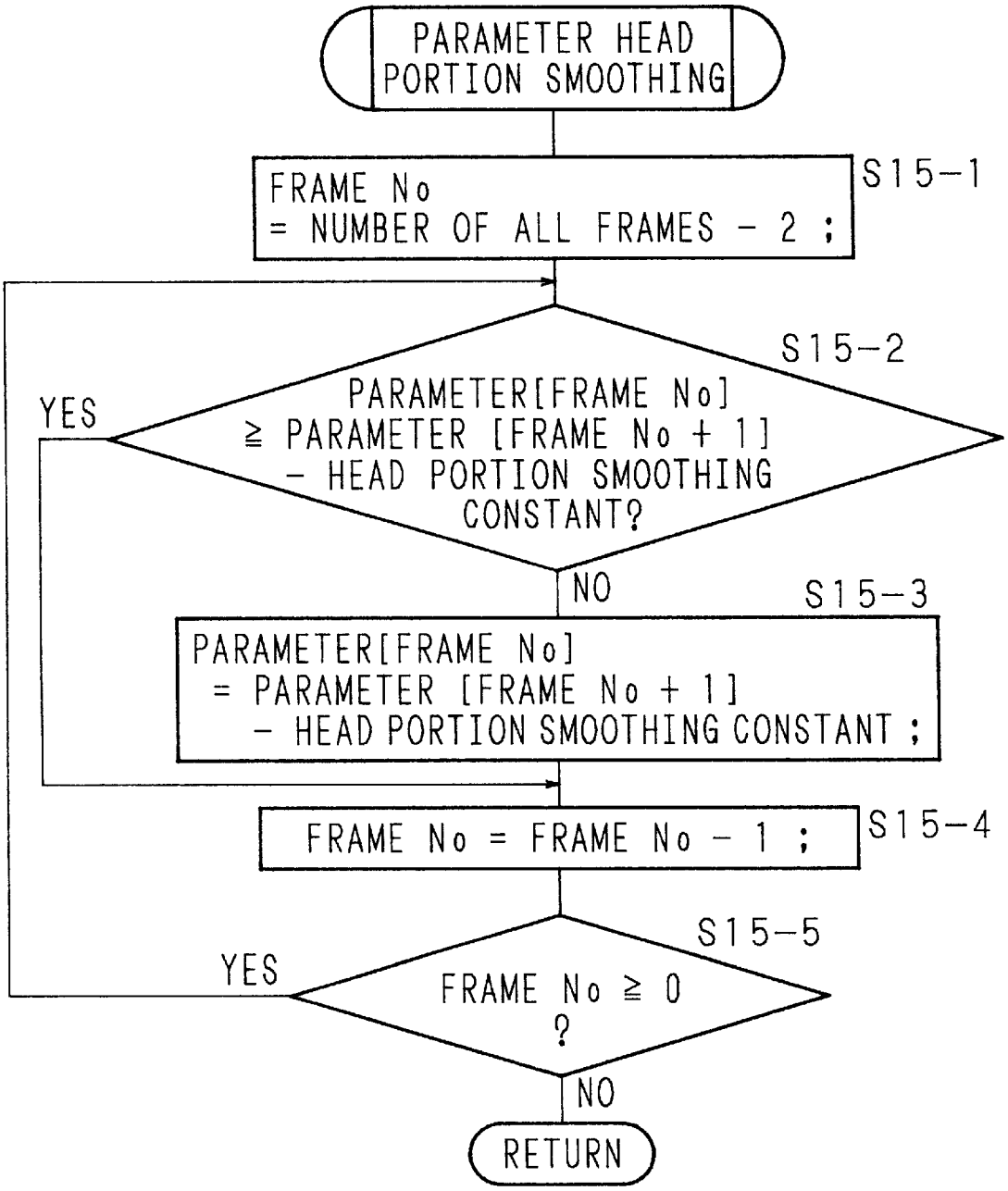
FIG. 15 is a flowchart of a process for parameter head portion smoothing in the apparatus according to the present invention.

FIG. 15 is a flowchart illustrating a process for parameter head portion smoothing (S12-3 and S12-6 in FIG. 12). Frame number is set to "total frame number-2" (S15-1). It is judged whether or not a parameter in the frame is equal to or more than a value obtained by subtracting a predetermined head portion smoothing constant from a parameter in the following frame (S15-2). Since the first frame is equal to or more than the questioned value, then the frame number is decremented by "1" (S15-4), and it is judged whether or not the frame number is "0" or more (S15-5). If it is "0" or more, the procedure returns to the step S15-2, and it is judged whether a parameter in the frame is equal to or more than a value determined by subtracting a prescribed head portion smoothing constant from a parameter in the following frame (S15-2). In the case where a parameter in the frame is less than the questioned value ("No" in S15-2), a parameter in that frame number is made to be a value obtained by subtracting the head portion smoothing constant from a parameter of the frame with the next frame number (S15-3). Until the frame number reaches "0" (S15-4), the above described steps S15-2 to S15-4 are repeated.

Figure 16:
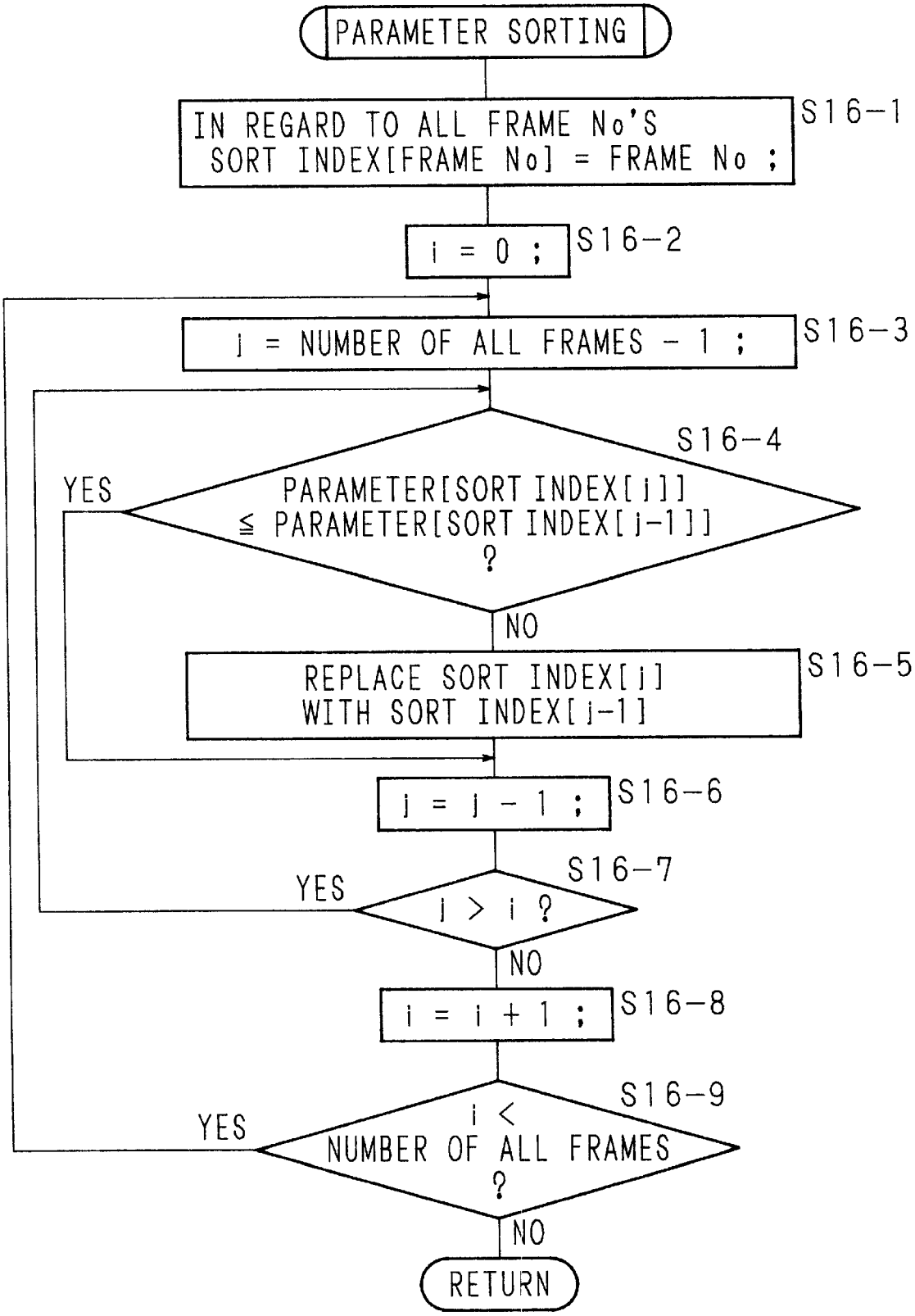
FIG. 16 is a flowchart of a process for parameter sorting in the apparatus according to the present invention.

FIG. 16 is a flowchart illustrating process for parameter sorting (S12-4 in FIG. 12). Initial values of sort index indicating the order in loudness of parameters are defined as frame numbers with respect to all the frame numbers (S16-1). A variable "i" of the number of frames to sort is initialized to "0" (S16-2), and "total frame number-1" is set to a sort index "j" (S16-3). First, it is judged whether or not a parameter in the frame of sort index [j] is equal to or less than a parameter in the frame of the previous sort index [j−1] (S16-4). If it is larger than the parameter in the frame of the previous sort index (No), the sort index [j] and the sort index [j−1] are switched (S16-5), then [j] is decremented by 1 (S16-6). On the other hand, if the parameter in the frame of the previous sort index is larger than that of sort index [j], "j" is decremented by 1 without changing the sort index (S16-6).

Value "i" is compared with that of "j" (S16-7), and as a result, the steps S16-4 to S16-6 are repeated until the value "j" reaches that of "i". When the value "j" comes to be equal to that of "i", "i" is incremented by 1 (S16-8), and the above described steps S16-3 to S16-8 are repeated until the value "i" reaches the total frame number (S16-9).

Figure 17:
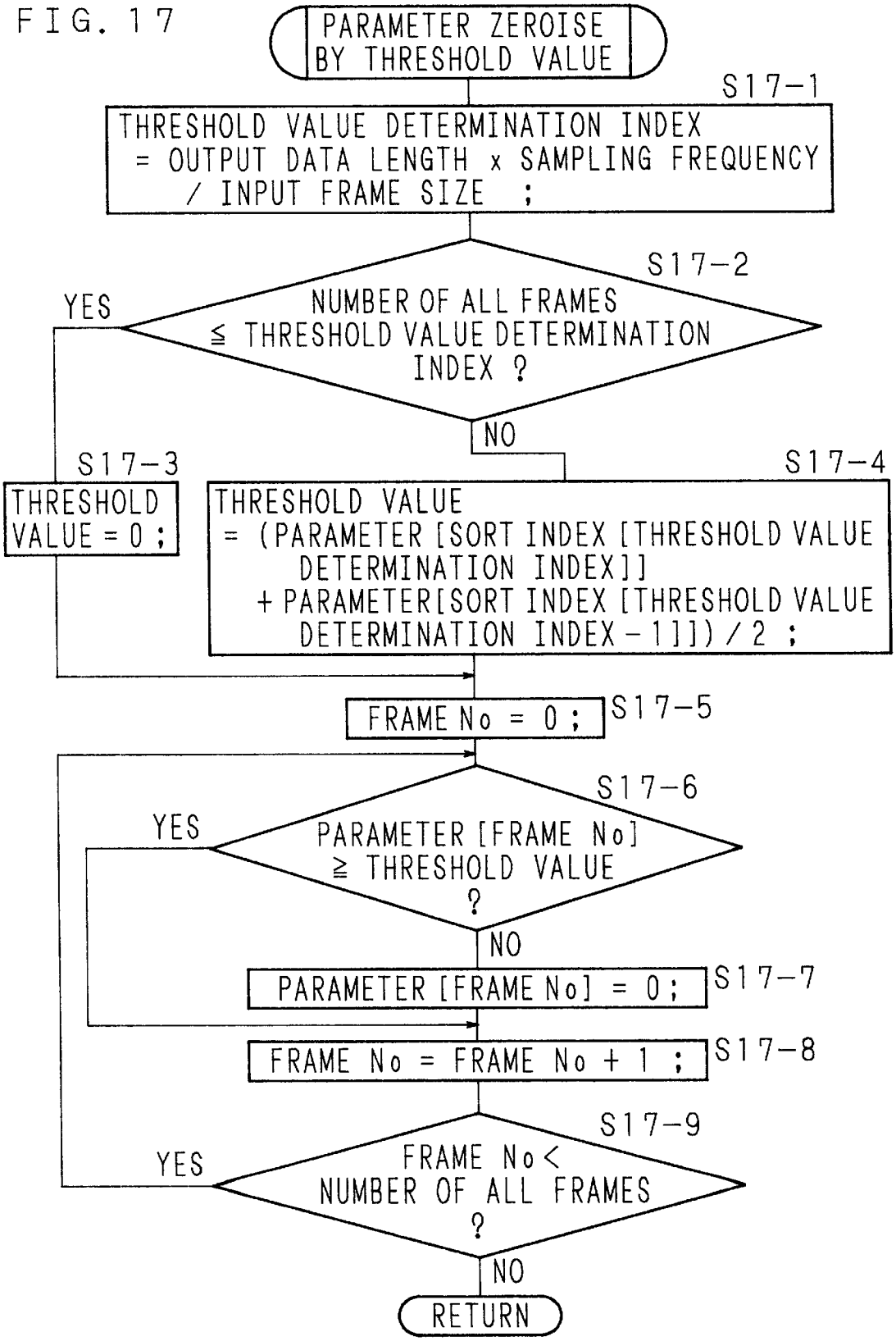
FIG. 17 is a flowchart of a parameter zeroising process by means of threshold value in the apparatus according to the present invention.

FIG. 17 is a flowchart illustrating a process for zeroising a parameter with a threshold value (S12-5 in FIG. 12) wherein unit in sampling frequency is Hz, and unit in output data length is second. A threshold value decision index is determined by "output data length×sampling frequency÷input frame size" (S17-1). It is judged whether or not the threshold value decision index is equal to or more than total frame number (S17-2). As a result, if the threshold value decision index is equal to or more than the total frame number, threshold value is made to be "0" (S17-3), while if the threshold value decision index is less than the total frame number, the threshold value is made to be "(parameter [sort index [threshold value decision index]]+parameter [sort index [threshold value decision index-1]])/2" (S17-4). Frame number is initialized to "0" (S17-5), and it is judged whether or not a parameter in the frame is equal to or more than the threshold value (S17-6). In case of less than the threshold value, the parameter in that frame is made to be "0" (S17-7), while the frame number is incremented by 1 with leaving the parameter in the frame as it is in case of equal to or more than the threshold value (S17-8). The above described steps S17-6 to S17-8 are repeated until the frame number reaches the total frame number (S17-9).

Figure 18:
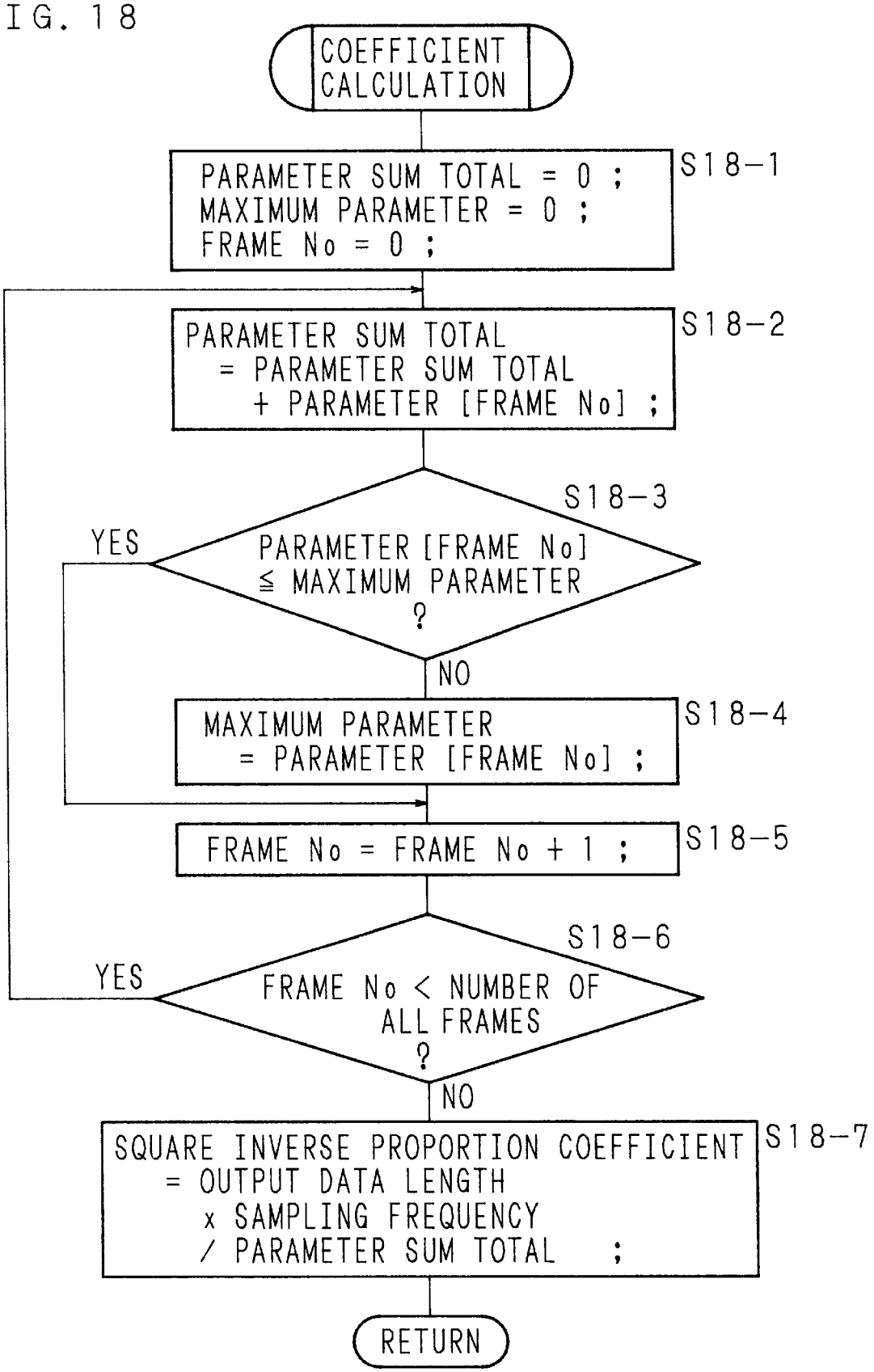
FIG. 18 is a flowchart of a process for coefficient calculation in the apparatus according to the present invention.

FIG. 18 is a flowchart illustrating a process for coefficient calculation (S11-3 in FIG. 11). Parameter sum total, maximum parameter, and frame number are initialized to "0", respectively (S18-1). To the parameter sum total is added a parameter of a frame to determine the parameter sum total (S18-2), and it is judged whether or not a parameter in the frame is equal to or less than the maximum parameter (S18-3). In case of exceeding the maximum parameter (No), the parameter in that frame is made to be the maximum parameter (S18-4), and the frame number is incremented by 1 (S18-5), while the frame number is incremented by 1 with leaving the maximum parameter as it is in the case where the parameter in that frame is equal to or less than the maximum parameter (S18-5). The above described steps S18-2 to S18-5 are repeated until the frame number reaches the total frame number (S18-6). When the frame number reaches the total frame number, a square inverse proportion coefficient is determined by "output data length×sampling frequency/parameter sum total" (S18-7).

Figure 19:
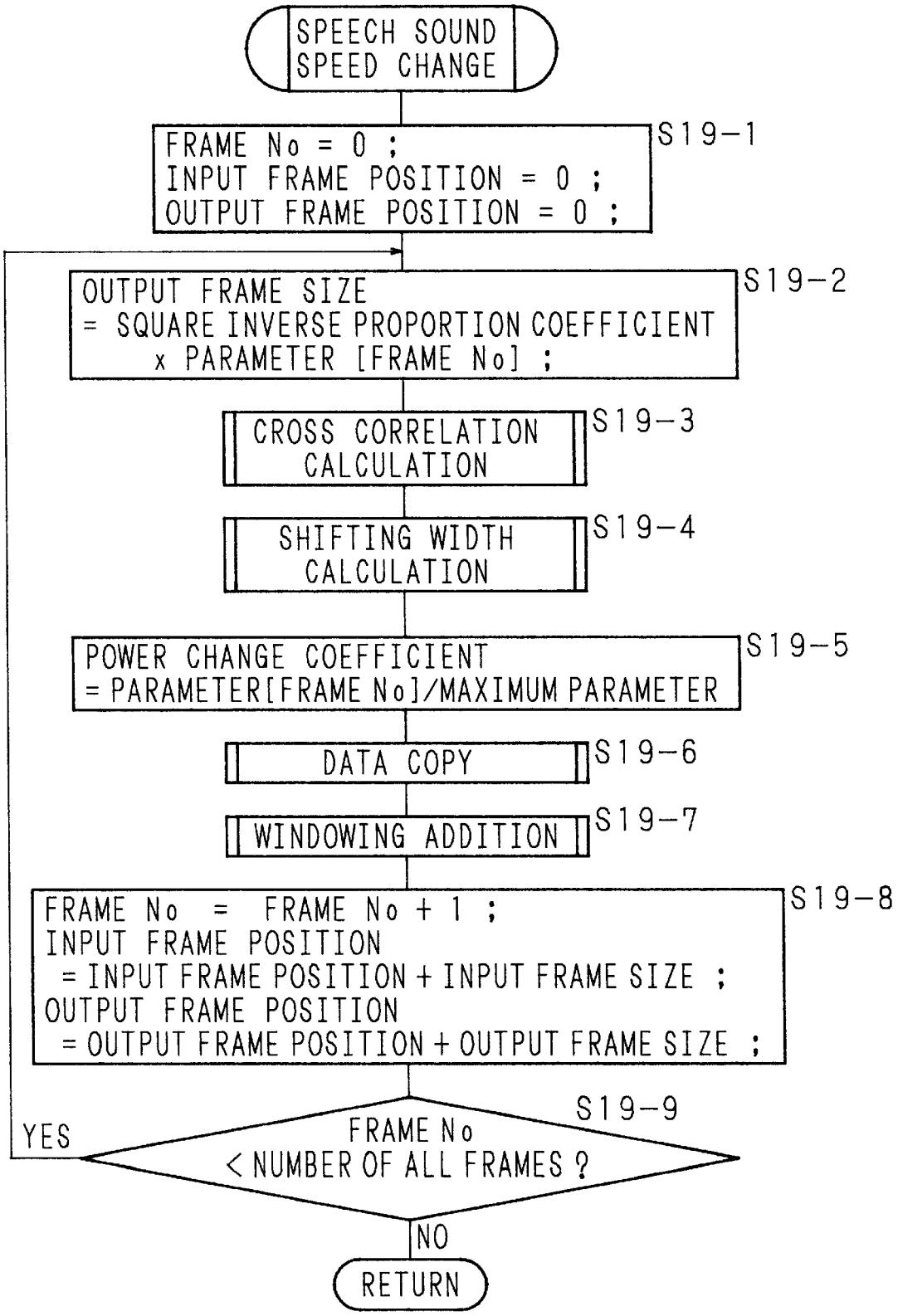
FIG. 19 is a flowchart of a process for reproduction speed change in the apparatus according to the present invention.

FIG. 19 is a flowchart illustrating a process for reproduction speed change (S11-4 in FIG. 11). Frame number, input frame position, and output frame position are initialized to "0", respectively (S19-1). A parameter of a frame is multiplied with the above-mentioned square inverse proportion coefficient to determine an output frame size (S19-2). Cross-correlation calculation is conducted with respect to the output frames (Sl9-3) to calculate a shifting width of the frame (Sl9-4). The parameter in that frame is divided by the maximum parameter to determine a power change coefficient in that frame (Sl9-5), and the data is copied to an output buffer (Sl9-6). A frame is shifted by the shifting width to window the head portion of the frame and the tail portion of the previous frame thereby conducting addition, so that waveforms are joined to each other (Sl9-7). The frame number, the input frame position, and the output frame position are incremented, respectively, by 1, by an input frame size, and by an output frame size (S19-8). The above described steps S19-2 to S19-8 are repeated until the frame number reaches the total frame number (S19-9).

Figure 20:
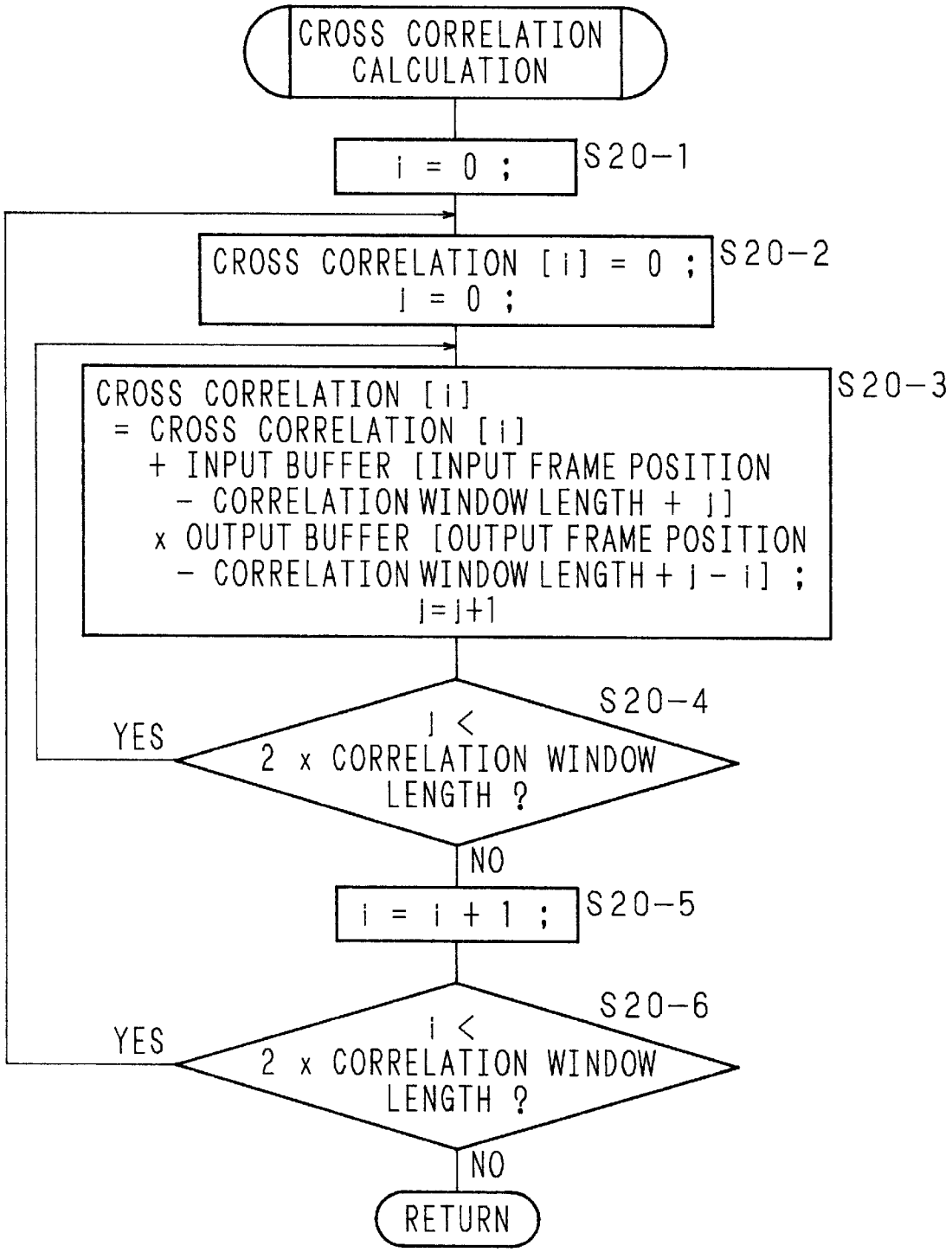
FIG. 20 is a flowchart of a process for cross correlation calculation in the apparatus according to the present invention.

FIG. 20 is a flowchart illustrating a process for cross-correlation calculation (S19-3 in FIG. 19). A variable "i" of a sampling point is initialized to "0" (S20-1), and cross-correlation of "i" at the sampling point as well as a variable "j" are initialized to "0", respectively (S20-2). The cross-correlation at the sampling point "i" is determined by "cross-correlation [i]+input buffer [input frame position−correlation window length+j]×output buffer [output frame position−correlation window length+j−i]", then "j" is incremented by 1 (S20-3). The step S20-3 is repeated until "j" exceeds doubled correlation window length (S20-4).

When "j" exceeds doubled correlation window length, "i" is incremented by 1 (S20-5), and the steps S20-2 to S20-5 are repeated until "i" exceeds doubled correlation window length (S20-6).

Figure 21:
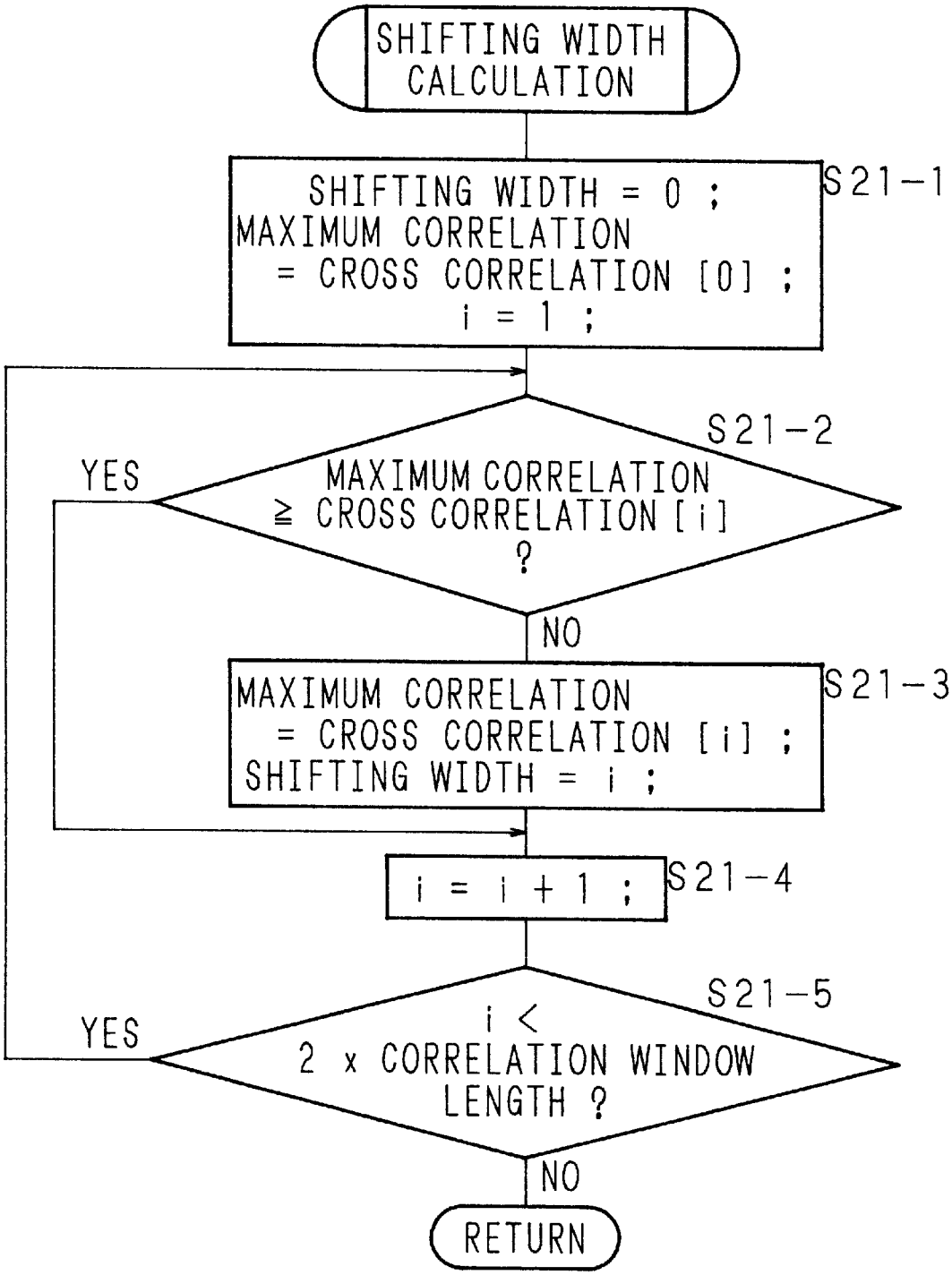
FIG. 21 is a flowchart of a process for shifting length calculation in the apparatus according to the present invention.

FIG. 21 is a flowchart illustrating a process for shifting width calculation (S19-4 in FIG. 19). Shifting width, maximum correlation, and the number "i" of sampling points are initialized to "0", cross correlation [0], and "1", respectively (S21-1). It is judged whether or not cross-correlation "i" is equal to or less than the maximum correlation (S21-2). In case of exceeding the maximum correlation (No), cross-correlation of a waveform at the sampling point "i" is set to the maximum correlation, shifting width is made to be "i" (S21-3), and "i" is incremented by 1 (S21-4), while "i" is incremented by 1 with leaving the maximum correlation and the shifting width as they are in the case where the cross-correlation is less than the maximum correlation (Yes) (S21-4). The above described steps S21-2 to S21-4 are repeated until "i" reaches doubled correlation window length (S21-5).

Figure 22:
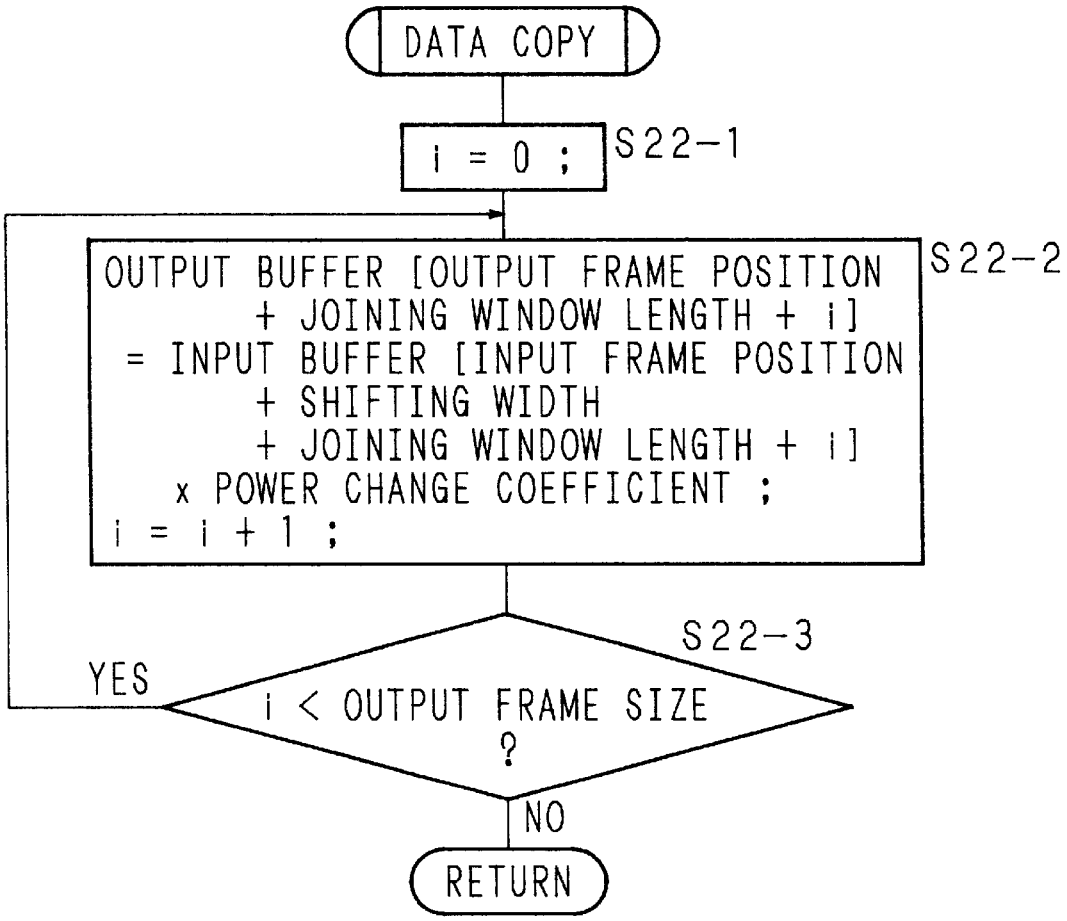
FIG. 22 is a flowchart of a process for data copying in the apparatus according to the present invention.

FIG. 22 is a flowchart illustrating a process for data copying (Sl9-6 in FIG. 19). A variable "i" of a sampling point is initialized to "0" (S22-1). To a storing position "output frame position+shifting width+i" of an output buffer is copied speech data obtained by multiplying the speech data at a storing position "input position+shifting width+joining window length+i" of an input buffer by a power change coefficient, and "i" is incremented by 1 (S22-2). The step S22-2 is repeated until the number of sampling points reaches the output frame size (S22-3).

Figure 23:
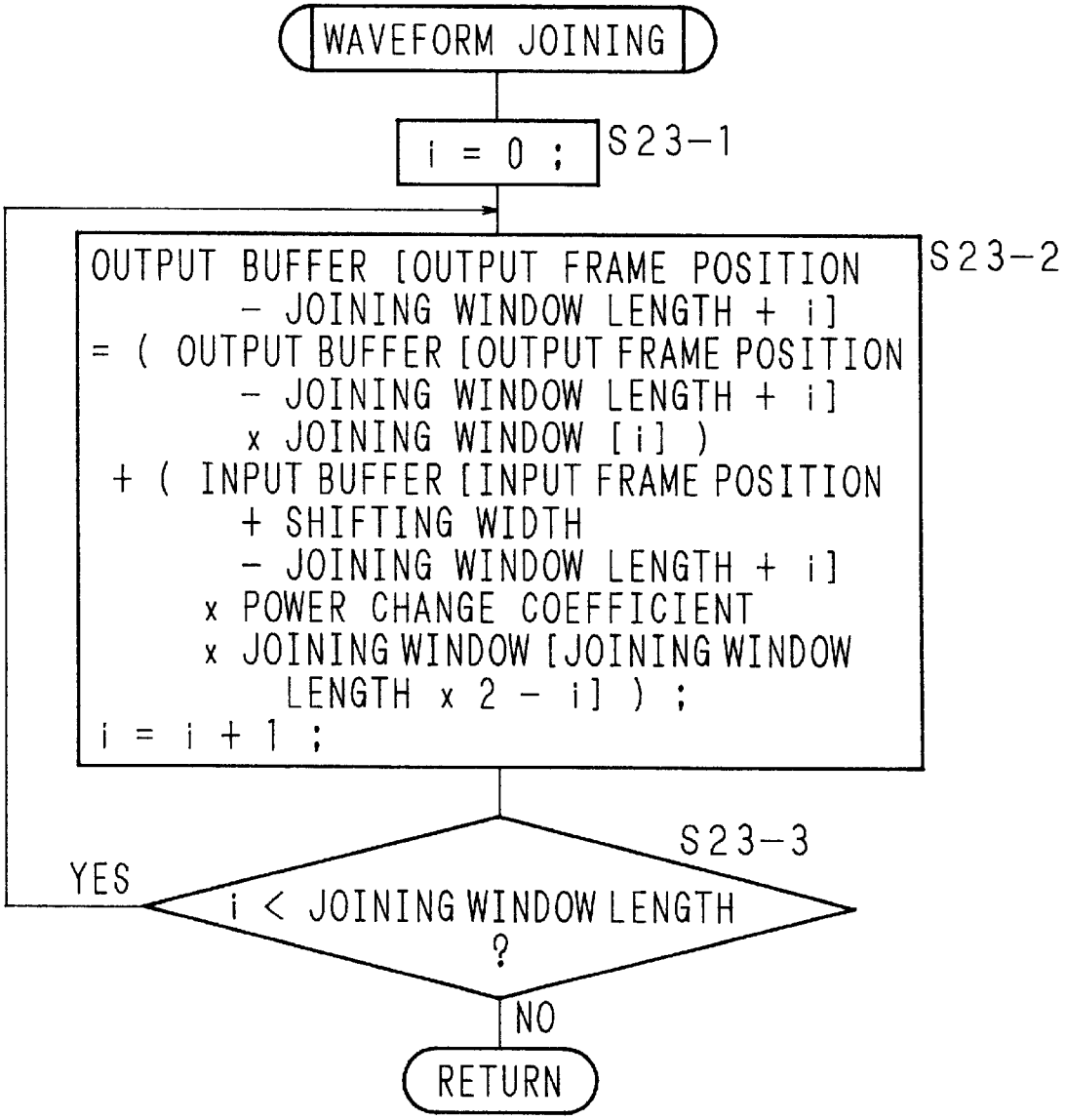
FIG. 23 is a flowchart of a process for joining waveforms (windowing addition) in the apparatus according to the present invention.

FIG. 23 is a flowchart illustrating a process for waveform joining (Sl9-7 window addition in FIG. 19). A variable "i" at a sampling point is initialized to "0" (S23-1). A value obtained as a result of addition of a value prepared by multiplying speech data at a storing position "output frame position−joining window width+i" of the output buffer by joining window [i] and a value prepared by multiplying speech data at a storing position "input frame position+shifting width−joining window length+i" of the input buffer by a power change coefficient as well as by the joining window [joining window length×2−i] is stored in a storing position "output frame position−joining window length+i" of the output buffer, and "i" is incremented by 1 (S23-2). The step S23-2 is repeated until the number of sampling points reaches "joining window length×2" (S23-3).

Figure 24:
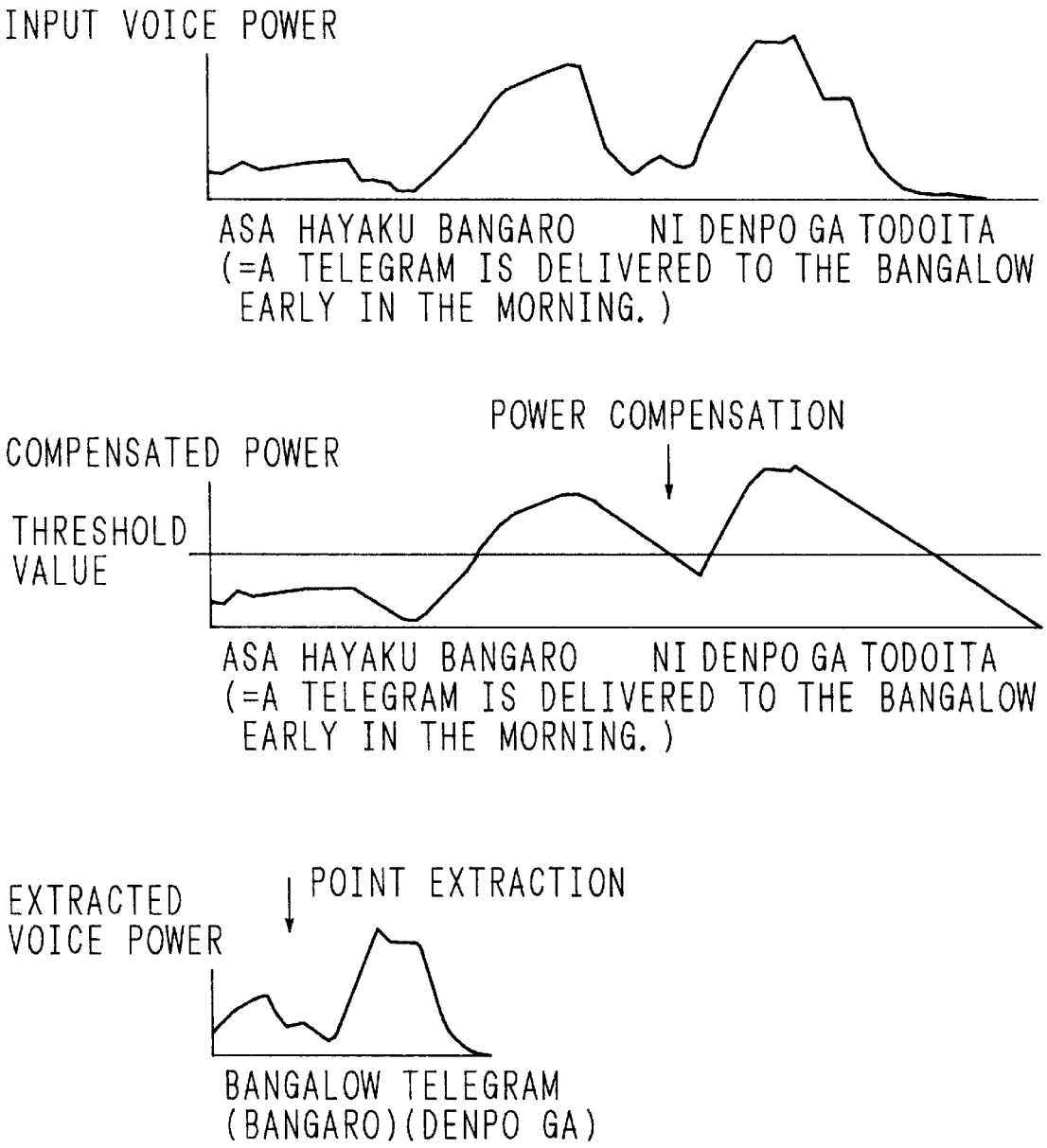
FIG. 24 is a power diagram showing a changing process in the apparatus according to the present invention.

FIG. 24 is a power diagram showing processes of reproduction speed change of the speech sound in the apparatus according to the present invention. With respect to input speech sound of "Asa hayaku/bangaro ni/denpo ga/todoita." in Japanese (It means that "A telegram is delivered to arrived a bungalow early in the morning."), its power is compensated in accordance with the above-mentioned power square calculation, the parameter tail portion smoothing, the parameter head portion smoothing, the parameter sorting as well as the parameter zeroising by a threshold value, the parameter tail portion smoothing, and the parameter head portion smoothing. In case of double-speed reproduction, all the voiced sounds are not evenly reproduced at a fast speed, but the speech data contained in a part having important contents wherein the words are spoken in a relatively louder voice or relatively higher pitch voice is selectively reproduced at a slow speed by which one can catch the words, so that the speech sound of "bangaro/denpo ga" is outputted. As a result, the outline of the speech sound can be caught by a hearer.

Figure 25:
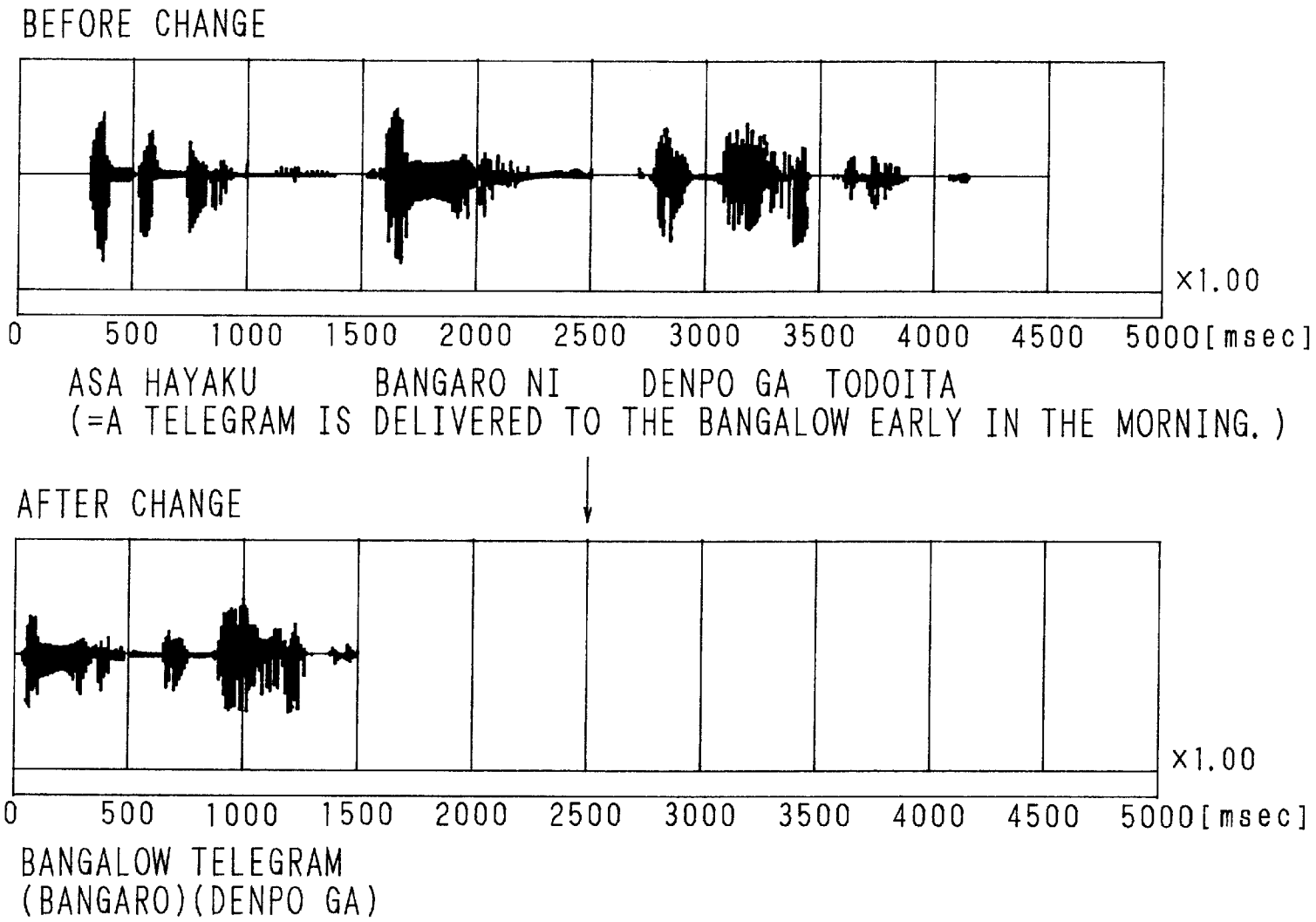
FIG. 25 is a diagram of waveforms showing change results in the apparatus according to the present invention.

FIG. 25 is a waveform diagram showing the result of reproduction speed change in case of triple-speed reproduction by means of the apparatus according to the present invention.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

We claim:

1. An apparatus for changing a reproduction speed of a speech sound wherein speech signals are reproduced by changing the speed without changing the pitch thereof, comprising:

a parameter calculation means for calculating a parameter value representing characteristics of speech signals in every predetermined period prepared by sectioning a period of said speech signals;

a reproduction speed calculation means for calculating a reproduction speed of the speech signals in every predetermined period according to the parameter value calculated by the parameter calculation means; and a reproduction speed changing means for producing reproduction data of respective predetermined periods on the basis of said reproduction speeds in the respective predetermined periods calculated by the reproduction speed calculation means, and for joining said reproduction data to each other thereby reproducing the speech signals.

2. The apparatus as claimed in claim 1, wherein said parameter value is that indicates loudness of the speech sound.

3. The apparatus as claimed in claim 2, wherein said reproduction speed calculation means is a means for calculating the reproduction speed of the speech signals in respective predetermined periods by proportioning the reproduction speed inversely to the respective parameter values.

4. The apparatus as claimed in claim 3, wherein said reproduction speed calculation means is a means for calculating the reproduction speed of the speech signals in respective predetermined periods by proportioning the reproduction speed inversely to n'th power of the respective parameter values.

5. The apparatus as claimed in claim 3, further comprising a means for inputting data relating to a total time for reproducing the speech signals, and a means for calculating an inverse proportion coefficient by which said speech signals can be reproduced within the total time according to said data inputted by said data inputting means.

6. The apparatus as claimed in claim 1, wherein said parameter value is that indicates pitch of speech sound.

7. The apparatus as claimed in claim 6, wherein said reproduction speed calculation means is a means for calculating the reproduction speed of the speech signals in respective predetermined periods by proportioning the reproduction speed inversely to the respective parameter values.

8. The apparatus as claimed in claim 7, wherein said reproduction speed calculation means is a means for calculating the reproduction speed of the speech signals in respective predetermined periods by proportioning the reproduction speed inversely to n'th power of the respective parameter values.

9. The apparatus as claimed in claim 7, further comprising a means for inputting data relating to a total time for reproducing the speech signals, and a means for calculating an inverse proportion coefficient by which said speech signals can be reproduced within the total time according to said data inputted by said data inputting means.

10. The apparatus as claimed in claim 1, wherein said reproduction speed calculation means is a means for calculating the reproduction speed of the speech signals in respective predetermined periods by proportioning the reproduction speed inversely to the respective parameter values.

11. The apparatus as claimed in claim 10, further comprising a means for inputting data relating to a total time for reproducing the speech signals, and a means for calculating an inverse proportion coefficient by which said speech signals can be reproduced within the total time according to said data inputted by said data inputting means.

12. The apparatus as claimed in claim 1, wherein said reproduction speed calculation means is a means for calculating the reproduction speed of the speech signals in respective predetermined periods by proportioning the reproduction speed inversely to n'th power of the respective parameter values.

13. The apparatus as claimed in claim 12, further comprising a means for inputting data relating to a total time for reproducing the speech signals, and a means for calculating an inverse proportion coefficient by which said speech signals can be reproduced within the total time according to said data inputted by said data inputting means.

14. The apparatus as claimed in claim 1, further comprising a coefficient calculation means for calculating a coefficient which decides an output power of reproduction data on the basis of a power of said reproduction data in each predetermined period according to the parameter value calculated by said parameter calculation means, wherein said reproduction speed changing means is provided with a means for deciding an output power of reproduction data in each predetermined period on the basis of the coefficient calculated by said coefficient calculation means.

15. The apparatus as claimed in claim 1, further comprising a means for setting a first predetermined value of said parameter value and a means for setting a second predetermined value of said parameter value, wherein said reproduction speed calculating means is provided with a means for setting the reproduction speed of the speech signals in a predetermined period to infinity, when the parameter value in the predetermined period calculated by said parameter calculation means is less than the first predetermined value, and a means for calculating the reproduction speed of the speech signals in said predetermined period according to the second predetermined value, when the parameter value in the predetermined period calculated by said parameter calculation means is more than the second predetermined value.

16. A method for changing a reproduction speed of a speech sound wherein speech signals are reproduced by changing the speed without changing the pitch thereof, comprising the steps of:

calculating a parameter value representing characteristics of speech signals in every predetermined period prepared by sectioning a period of said speech signals;

calculating a reproduction speed of the speech signals in every predetermined period according to the parameter value calculated; and producing reproduction data of respective predetermined periods on the basis of said reproduction speeds in the respective predetermined periods and joining said reproduction data to each other thereby reproducing the speech signals.

17. A recording medium readable by a computer which changes a reproduction speed of a speech sound wherein speech signals are reproduced by changing the speed, said recording medium comprising;

a program code means for causing said computer to calculate a parameter value representing characteristics of speech signals in every predetermined period prepared by sectioning a period of said speech signals;

a program code means for causing said computer to calculate a reproduction speed of the speech signals in every predetermined period according to the parameter value calculated; and a program code means for causing said computer to produce reproduction data of respective predetermined periods on the basis of said reproduction speeds in the respective predetermined periods and to join said reproduction data to each other thereby reproducing the speech signals.

18. An apparatus for changing a reproduction speed of a speech sound wherein speech signals are reproduced by changing the speed without changing the pitch thereof, comprising:

a parameter calculation means for calculating a parameter value representing characteristics of speech signals in every predetermined period prepared by sectioning a period of said speech signals;

a reproduction speed calculation means for calculating a reproduction speed of voiced sounds contained in speech signals in each of reproducing period extracted from a plurality of the predetermined periods on the basis of the total reproduction speed, according to the parameter value of each predetermined period calculated by the parameter calculation means; and a reproduction speed changing means for producing reproduction data of voiced sounds contained in the speech signals of each reproducing period on the basis of said reproduction speed of each reproducing period calculated by the reproduction speed calculating means and for joining said reproduction data to each other thereby reproducing the speech signals.

19. The apparatus as claimed in claim 18, wherein said parameter value is that indicates loudness of the speech sound.

20. The apparatus as claimed in claim 19, wherein said reproduction speed calculation means is a means for calculating the reproduction speed of the speech signals in respective predetermined periods by proportioning the reproduction speed inversely to the respective parameter values.

21. The apparatus as claimed in claim 20, wherein said reproduction speed calculation means is a means for calculating the reproduction speed of the speech signals in respective predetermined periods by proportioning the reproduction speed inversely to n'th power of the respective parameter values.

22. The apparatus as claimed in claim 20, further comprising a means for inputting data relating to a total time for reproducing the speech signals, and a means for calculating an inverse proportion coefficient by which said speech signals can be reproduced within the total time according to said data inputted by said data inputting means.

23. The apparatus as claimed in claim 18, wherein said parameter value is that indicates pitch of speech sound.

24. The apparatus as claimed in claim 23, wherein said reproduction speed calculation means is a means for calculating the reproduction speed of the speech signals in respective predetermined periods by proportioning the reproduction speed inversely to the respective parameter values.

25. The apparatus as claimed in claim 24, wherein said reproduction speed calculation means is a means for calculating the reproduction speed of the speech signals in respective predetermined periods by proportioning the reproduction speed inversely to n'th power of the respective parameter values.

26. The apparatus as claimed in claim 24, further comprising a means for inputting data relating to a total time for reproducing the speech signals, and a means for calculating an inverse proportion coefficient by which said speech signals can be reproduced within the total time according to said data inputted by said data inputting means.

27. The apparatus as claimed in claim 18, wherein said reproduction speed calculation means is a means for calculating the reproduction speed of the speech signals in respective predetermined periods by proportioning the reproduction speed inversely to the respective parameter values.

28. The apparatus as claimed in claim 27, further comprising a means for inputting data relating to a total time for reproducing the speech signals, and a means for calculating an inverse proportion coefficient by which said speech signals can be reproduced within the total time according to said data inputted by said data inputting means.

29. The apparatus as claimed in claim 18, wherein said reproduction speed calculation means is a means for calculating the reproduction speed of the speech signals in respective predetermined periods by proportioning the reproduction speed inversely to n'th power of the respective parameter values.

30. The apparatus as claimed in claim 29, further comprising a means for inputting data relating to a total time for reproducing the speech signals, and a means for calculating an inverse proportion coefficient by which said speech signals can be reproduced within the total time according to said data inputted by said data inputting means.

31. The apparatus as claimed in claim 18, further comprising a coefficient calculation means for calculating a coefficient which decides an output power of reproduction data on the basis of a power of said reproduction data in each predetermined period according to the parameter value calculated by said parameter calculation means, wherein said reproduction speed changing means is provided with a means for deciding an output power of reproduction data in each predetermined period on the basis of the coefficient calculated by said coefficient calculation means.

32. The apparatus as claimed in claim 18, further comprising a means for setting a first predetermined value of said parameter value and a means for setting a second predetermined value of said parameter value, wherein said reproduction speed calculating means is provided with a means for setting the reproduction speed of the speech signals in a predetermined period to infinity, when the parameter value in the predetermined period calculated by said parameter calculation means is less than the first predetermined value, and a means for calculating the reproduction speed of the speech signals in said predetermined period according to the second predetermined value, when the parameter value in the predetermined period calculated by said parameter calculation means is more than the second predetermined value.

33. An apparatus for changing a reproduction speed of a speech sound wherein speech signals are reproduced by changing the speed without changing the pitch thereof, comprising:

a parameter calculation means for calculating a parameter value representing characteristics of speech signals in every predetermined period prepared by sectioning a period of said speech signals, and smoothing the speech signal waveform having a parameter value equal to or more than a predetermined threshold value;

a reproduction speed calculation means for extracting speech signals of each of reproducing periods on the basis of the total reproducing speed from speech signals in a plurality of the predetermined periods, and calculating a changing coefficient for changing a reproduction speed in each reproducing period of voiced sounds contained in the speech signals thereof to the reproduction speed corresponding to the parameter value of each predetermined period calculated by the parameter calculation means; and a reproduction speed changing means for producing reproduction data of the voiced sounds contained in the speech signals of each reproducing period on the basis of said reproduction speed of each reproducing period calculated by the reproduction speed calculating means and for joining said reproduction data to each other thereby reproducing the speech signals.

* * * * *